US005594047A

United States Patent [19]

Nielsen et al.

[11] Patent Number: 5,594,047

[45] Date of Patent: Jan. 14, 1997

[54] METHOD FOR FORMING PHOTOGRAPHIC DISPERSIONS COMPRISING LOADED LATEX POLYMERS

[75] Inventors: Ralph B. Nielsen, Rochester; Thomas A. Rosiek, Honeoye Falls; David F. Bates, Rochester; James S. Honan, Spencerport; Hwei-Ling Yau, Rochester, all of N.Y.

[73] Assignee: Eastman Kodak Company, Rochester, N.Y.

[21] Appl. No.: 390,400

[22] Filed: Feb. 17, 1995

[51] Int. Cl.[6] ..... G03C 1/815

[52] U.S. Cl. ..... 523/315; 523/318; 523/319; 430/510; 430/517; 430/519; 430/539; 430/544; 430/547

[58] Field of Search ..... 523/315, 318, 523/319; 430/517, 539, 519, 510, 544, 547, 549

[56] References Cited

U.S. PATENT DOCUMENTS

| | | | |
|---|---|---|---|
| 2,772,163 | 11/1956 | Tong | 96/97 |
| 2,852,382 | 9/1958 | Illingsworth et al. | 96/97 |
| 3,619,195 | 11/1971 | Van Campen | 96/100 |
| 4,199,363 | 4/1980 | Chen | 430/512 |
| 4,203,716 | 5/1980 | Chen | 430/207 |
| 4,304,769 | 12/1981 | Chen | 424/218 |
| 4,358,533 | 11/1982 | Tokitou et al. | 430/512 |
| 4,368,258 | 1/1983 | Fujiwhara et al. | 430/493 |
| 4,388,403 | 6/1983 | Helling et al. | 430/546 |
| 4,490,461 | 12/1984 | Webb et al. | 430/510 |
| 4,675,352 | 6/1987 | Winter et al. | 524/91 |
| 4,724,197 | 2/1988 | Matejec et al. | 430/377 |
| 4,822,728 | 4/1989 | Loiacono et al. | 430/551 |
| 4,840,885 | 6/1989 | Peters et al. | 430/559 |
| 4,857,449 | 8/1989 | Ogawa et al. | 430/546 |
| 4,891,309 | 1/1990 | Uesawa et al. | 430/627 |
| 4,914,005 | 4/1990 | Lau et al. | 430/377 |
| 4,916,050 | 4/1990 | Nishijima et al. | 430/546 |
| 4,927,743 | 5/1990 | Tamoto | 430/496 |
| 4,939,077 | 7/1990 | Helling et al. | 430/527 |
| 4,946,770 | 8/1990 | Takahashi et al. | 430/545 |
| 4,990,435 | 2/1991 | Vallarino et al. | 430/546 |
| 5,001,045 | 3/1991 | Furutachi et al. | 430/545 |
| 5,008,179 | 4/1991 | Chari et al. | 430/546 |
| 5,026,631 | 6/1991 | Yoneyama | 430/545 |
| 5,047,315 | 9/1991 | Morigaki et al. | 430/544 |
| 5,047,316 | 9/1991 | Hirano et al. | 430/545 |
| 5,055,386 | 10/1991 | Hirano et al. | 430/545 |
| 5,071,738 | 12/1991 | Mizukura et al. | 430/546 |
| 5,077,188 | 12/1991 | Tanji et al. | 430/546 |
| 5,091,296 | 2/1992 | Bagchi et al. | 430/546 |
| 5,100,771 | 3/1992 | Mihayashi et al. | 430/546 |
| 5,242,788 | 9/1993 | Takahashi et al. | 430/558 |
| 5,270,354 | 12/1993 | Vermeersch et al. | 523/334 |
| 5,278,037 | 1/1994 | Karino | 430/513 |
| 5,279,931 | 1/1994 | Bagchi et al. | 430/449 |
| 5,294,527 | 3/1994 | Deguchi | 430/545 |
| 5,300,417 | 4/1994 | Lushington et al. | 430/536 |
| 5,370,983 | 12/1994 | Shono et al. | 430/546 |
| 5,391,470 | 2/1995 | Yasuda et al. | 430/517 |

FOREIGN PATENT DOCUMENTS

| | | |
|---|---|---|
| 606178 | 10/1960 | Canada . |
| 324476 | 7/1989 | European Pat. Off. . |
| 483416 | 5/1992 | European Pat. Off. . |
| 586974 | 3/1994 | European Pat. Off. . |
| 591861A1 | 4/1994 | European Pat. Off. . |
| 60/140344 | 7/1985 | Japan . |
| 1287013 | 8/1972 | United Kingdom . |

OTHER PUBLICATIONS

Copending applications USSN 08/390,722 and USSN 08/390,442 both filed Feb. 17, 1995.

Abstract for Japanese Patent Application 58/149038

Research Disclosure, Jul. 1980; Item 19551, entitled "Use of Latices In Photographic Elements".

Research Disclosure, Jul. 1980; Item 19551, entitled "Use of Latices In Photographic Elements".

*Primary Examiner*—Edward J. Cain

*Attorney, Agent, or Firm*—Andrew J. Anderson

[57] ABSTRACT

Loaded latex dispersions of hydrophobic photographically useful compounds with a wide variety of polymer latices are prepared by preparing an oil phase solution of the hydrophobic compound or compounds, preferably essentially free of water-miscible or volatile solvent, combining the oil solution with one or more aqueous solutions, at least one of which contains a polymer latex, and mixing the combination of oil solution, aqueous solution and latex under high shear or turbulence sufficient to cause loading of the photographically useful compound into the dispersed polymer latex wherein the pH of the mixture does not need to be significantly changed.

21 Claims, No Drawings

METHOD FOR FORMING PHOTOGRAPHIC DISPERSIONS COMPRISING LOADED LATEX POLYMERS

FIELD OF THE INVENTION

The present invention relates to a method for forming photographic dispersions comprising hydrophobic photographically useful compounds dispersed in an aqueous solution. More particularly, it relates to the use of polymer latexes in such a method.

BACKGROUND OF THE INVENTION

The use of polymers in dispersions of photographic couplers and other photographically useful compounds is known in the art. Generally, polymer-containing dispersions are prepared with use of auxiliary solvents, i.e., volatile organic solvents or organic solvents with substantial water solubility. The polymer, coupler (or other photographically useful compound), and optionally other non-volatile solvent or hydrophobic components are combined with a volatile or substantially water-soluble solvent to form an organic solution. The organic solution is then emulsified in an aqueous medium, often containing gelatin and a surfactant, and the auxiliary solvent removed by evaporation or by washing the gelled dispersion with water. For either of these processes, ethyl acetate is often a preferred auxiliary solvent.

Photographic elements containing these polymer-containing dispersions may exhibit many advantages, including improved image preservability, improved physical properties, improved incubation storage before processing, and improved yellow leuco dye conversion.

The use of auxiliary solvent is important to the process of preparing polymer-containing dispersions. The solvent allows the coupler, polymer, and any other hydrophobic dispersions components to be combined in a mixed solution, so that a dispersion with an oil phase of uniform composition is obtained. The solvent also lowers the viscosity of the oil solution, which allows the preparation of small-particle emulsified dispersions. However, the use of auxiliary solvent also presents severe difficulties in the preparation of photographic dispersions and elements. First, the auxiliary solvent does not allow for the introduction of many types of polymers. Polymers of high molecular weight cannot be easily introduced, because the high oil-phase viscosity does not allow for the formation of small-particle dispersions, as discussed in U.S. Pat. No. 5,055,386 and EP 586,974. Crosslinked polymers cannot be introduced in this manner. Large amounts of auxiliary solvent and high mixing energy are often necessary to prepare small-particle dispersions with polymers of even modest molecular weight. A second difficulty with auxiliary solvent is that it can cause severe coating defects if it is not removed before the coating operation. Third, the steps of evaporating volatile solvent from an evaporated dispersion and washing a chill-set, washed dispersion leads to final photographic dispersions with variable concentration, so that careful analysis is necessary to determine the actual concentration of the photographically useful compound in the dispersion. Fourth, the volatile or water-soluble auxiliary solvents present health, safety, and environmental hazards, with risks of exposure, fire, and contamination of air and water. Fifth, the cost can be significant for the solvent itself, as can be the costs of environmental and safety controls, solvent recovery, and solvent disposal.

Direct dispersion processes avoid the use of auxiliary solvents. In one such process, the hydrophobic components desired in the dispersion, typically coupler and coupler solvent, are simply melted at a temperature sufficient to obtain a homogeneous oil solution. This is then emulsified or dispersed in an aqueous phase, often containing gelatin and surfactant. With appropriate emulsification conditions, small-particle dispersions of much less than 1 micron diameter are obtained by this process. The direct process also yields a dispersion with a known concentration of the photographically useful compound, based on the components added, with no variability due to evaporation or washing steps. No volatile or water-soluble organic solvents are needed, eliminating the hazards and costs associated with their use. The direct dispersion process, however, cannot be generally applied to the preparation of polymer-containing dispersions. Homogeneous molten oil solutions of most couplers and coupler solvents dissolve only limited amounts or types of polymers, even with low molecular weight. And soluble polymers increase the viscosity of the oil phase dramatically, so that small-particle dispersions cannot usually be prepared.

The use of latex or dispersed polymers in the preparation of photographic dispersions has also been previously proposed in the art. Usually these latex polymers are prepared by emulsion polymerization, although emulsified dispersions of organic-soluble polymers are also described. Loaded latex dispersions, in which a hydrophobic photographically useful compound is "loaded" into the latex polymer particles, are described in, e.g., U.S. Pat. Nos. 4,203,716, 4,304,769 and 4,368,258. The usual procedure for preparing a loaded latex is to combine a solution of the hydrophobic photographically useful compound in a water-miscible organic solvent with the aqueous latex. The resulting mixture, which typically has about a 1:1 ratio of water to organic solvent, is diluted with water or the organic solvent is removed by evaporation, with the result that the hydrophobic compound becomes associated with or dissolved in the latex particles. Variations on this procedure vary the order of addition of the organic solution and aqueous latex, substitute water-immiscible volatile auxiliary solvents for the water-miscible auxiliary solvents, incorporate the water-miscible organic solvent in the emulsion polymerization step, or require the formation of intermediate water-in-oil emulsions of the latex in volatile organic solvent before the formation of the final oil-in-water loaded latex dispersion. In some cases, photographically useful compounds are dissolved in the organic monomers prior to emulsion polymerization. Procedures are also described in which base-ionizable couplers and/or base-ionizable latex polymers are combined at high pH, often with auxiliary solvent present, followed by neutralization and/or addition of magnesium salts or alkaline-earth metal salts, to form a dispersion of coupler and polymer.

All of these procedures for preparing loaded-latex or latex-containing dispersions present severe practical difficulties. Rigid requirements exist for both the hydrophobic compound and the latex, especially for the procedures which use water-miscible organic solvent. In the initial mixture of hydrophobic compound, water-miscible organic solvent, and latex, the hydrophobic compound must not be precipitated by the aqueous environment, and the latex must not be coagulated by the large amount of organic solvent present. Many patents in the prior art describe a test for latex loadability, in which a suitable latex must not coagulate when mixed with an equal volume of the water-miscible organic solvent used in the dispersion preparation. Most latex polymers do not meet this requirement. A second problem with evaporated and washed dispersions is the manufacturing, environmental and safety concerns detailed above that result from the use of auxiliary solvents. Polymerization of monomers with photographically useful compounds dissolved in the monomers can cause free-radical destruction of the compounds and can impair the polymerization process, leading to unwanted crosslinking, or lowered polymer molecular weight, and to higher levels of residual monomer. None of the prior art describes procedures for loading latex polymers without the use of water-miscible or volatile auxiliary solvent at some point in the procedure. Additionally, it is often difficult or impossible to achieve high loading levels, i.e., greater than about a 1:1 ratio, of the hydrophobic compound or compounds in the latex, using the known methods.

PROBLEMS TO BE SOLVED

It is an object of the present invention to provide a method for preparing photographic dispersions in which hydrophobic photographically useful compounds are loaded in a latex polymer by a procedure requiring essentially no volatile or water-miscible solvent. It is a further object of this invention to prepare polymer-containing compositions of photographic dispersions which cannot be prepared by other known methods. Another object is to achieve control of photographic dispersion particle size by the use of a latex polymer. Another object of this invention is the preparation of dispersions which may be readily prepared with a wide range of possible ratios of hydrophobic compound to polymer. Yet another object of this invention is to prepare photographic dispersions with superior stability toward crystallization of the loaded component. Another object is the preparation of photographic elements comprising such dispersions with superior attributes, including color reproduction, sensitometric stability of the element to natural aging before processing, image preservability toward light, heat, and humidity, and resistance to scratching or delamination. Other objects of this invention will be apparent in this disclosure.

SUMMARY OF THE INVENTION

We have found that loaded latex dispersions of hydrophobic photographically useful compounds with a wide variety of polymer latices can be prepared by a procedure which consists of preparing an oil phase solution of the hydrophobic compound or compounds which is most preferably essentially free of water-miscible or volatile solvent, combining the oil solution with one or more aqueous solutions, at least one of which contains a polymer latex, and mixing the combination of oil solution, aqueous solution and latex under high shear or turbulence.

In a preferred embodiment, the photographically useful compound or compounds and optional high-boiling solvents are combined at a temperature sufficient to prepare a liquid solution of the oil components. This oil solution is then combined with an aqueous solution containing gelatin and surfactant. A polymer latex is either included in the aqueous solution before the oil phase is added, or is added after the oil and aqueous solutions have been combined. The mixture is then mixed under conditions of high shear or turbulence sufficient to cause loading of the photographically useful compound into the dispersed polymer latex wherein the pH of the mixture does not need to be significantly changed.

ADVANTAGEOUS EFFECT OF THE INVENTION

The method of the invention allows for the preparation of loaded latex dispersions of polymers which cannot be loaded by other known methods, and eliminates the need for the use of auxiliary solvents. The process can yield dispersion particles which are much smaller than those prepared by normal direct dispersion processes without added latex. The process can yield dispersions and photographic elements with superior attributes, including dispersion stability, and photographic color reproduction, image preservability, and abrasion resistance.

DETAILED DESCRIPTION OF THE INVENTION

The process of the invention is generally applicable to forming loaded latex dispersions of photographically useful compounds which may be used at various locations throughout a photographic element.

Photographically useful compounds which can be loaded into polymer latices include photographic couplers (including yellow, magenta and cyan image-forming couplers, colored or masking couplers, inhibitor-releasing couplers, and bleach accelerator-releasing couplers, dye-releasing couplers, etc.), UV absorbers, preformed dyes (including filter dyes), high-boiling organic solvents, reducing agents (including oxidized developer scavengers and nucleators), stabilizers (including image stabilizers, stain-control agents, and developer scavengers), developing agents, development boosters, development inhibitors and development moderators, optical brighteners, lubricants, etc.

Oil components of the dispersions of the invention may include couplers.

Image dye-forming couplers may be included in the element such as couplers that form cyan dyes upon reaction with oxidized color developing agents which are described in such representative patents and publications as: U.S. Pat. Nos. 2,772,162; 2,895,826; 3,002,836; 3,034,892; 2,474,293; 2,423,730; 2,367,531; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,600,788; 2,369,489; 2,343,703; 2,311,082; 3,152,896; 3,519,429; 3,062,653; 2,908,573 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. In a preferred embodiment of the invention, an acetanilide yellow coupler is used which has the formula:

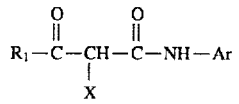

wherein $R_1$ is an alkyl, aryl, anilino, alkylamino or heterocyclic group; Ar is an aryl group; and X is hydrogen or a coupling-off group. The $R_1$, Ar and X groups may each contain further substituents as is well known in the art. $R_1$ is preferably:

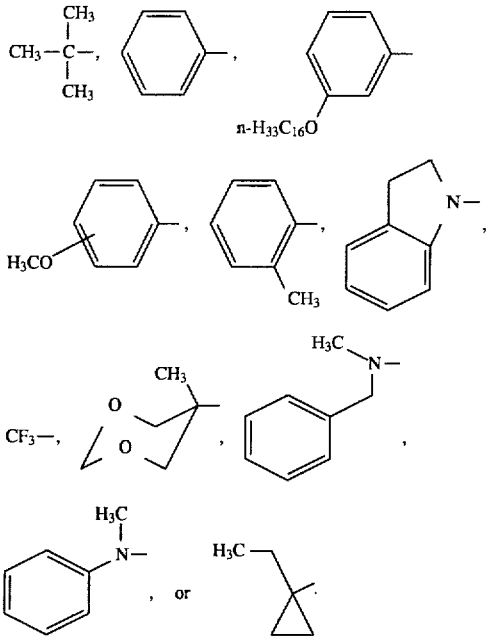

In particularly preferred embodiments of the invention a pivaloylacetanilide yellow coupler is used wherein $R_1$ is t-butyl.

Ar is preferably substituted phenyl wherein at least one substituent is halo, alkoxy or aryloxy. Ar preferably additionally contains a ballasting group. Ballasting groups usually comprise one or more 5 to 25 carbon atom containing organic moieties whose function is to immobilize the coupler and the formed image dye during photographic development by imparting poor water diffusibility to the coupler compound.

X is a hydrogen or a coupling-off group. Coupling-off groups are generally organic groups which are released during photographic processing. The released coupling-off group can be a photographically useful group.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

Generally the presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169; 3,227,551; 3,432,521; 3,476,563; 3,617,291; 3,880,661; 4,052,212; and 4,134,766; and in U.K. Patents and published application Nos. 1,466,728, 1,531,927, 1,533,039, 2,006,755A and 2,017,704A, the disclosures of which are incorporated herein by reference.

It may be useful to use a combination of couplers any of which may contain known ballasts or coupling-off groups such as those described in U.S. Pat. Nos. 4,301,235; 4,853,319 and 4,351,897. The coupler may also be used in association with "wrong" colored couplers (e.g. to adjust levels of interlayer correction) and, in color negative applications, with masking couplers such as those described in EP 213,490; Japanese Published Application 58-172,647; U.S. Pat. No. 2,983,608; German Application DE 2,706,117C; U.K. Patent 1,530,272; Japanese Application A-113935; U.S. Pat. Nos. 4,070,191 and 4,273,861; and German Application DE 2,643,965. The masking couplers may be shifted or blocked.

Typical couplers that can be used with the elements of this invention include those shown below.

C-1

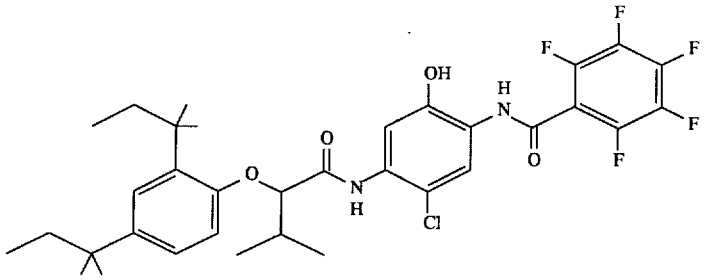

-continued
C-2
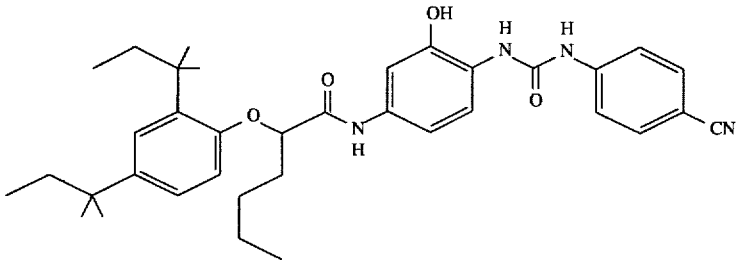
C-3
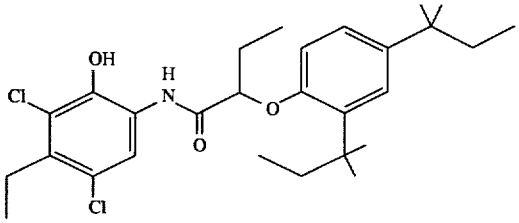
C-4
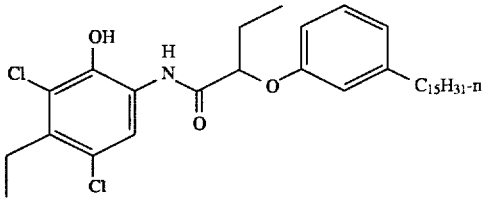
C-5
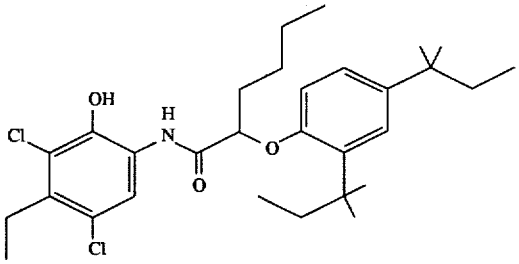
C-6
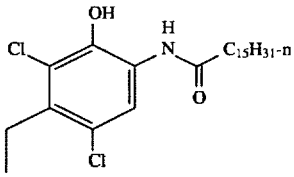
C-7
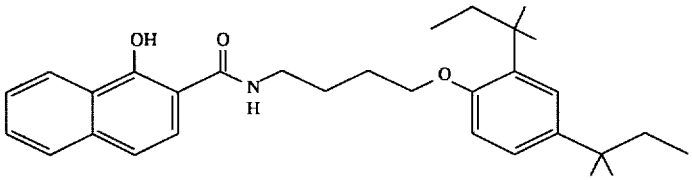
C-8
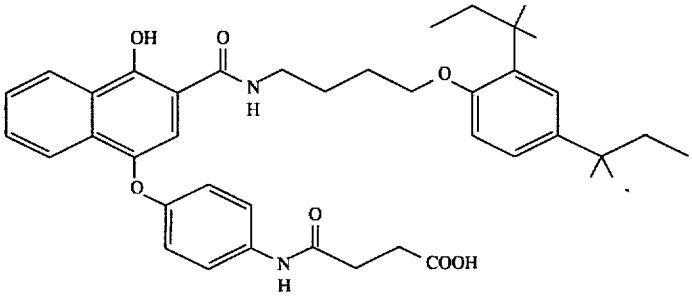

-continued
C-9
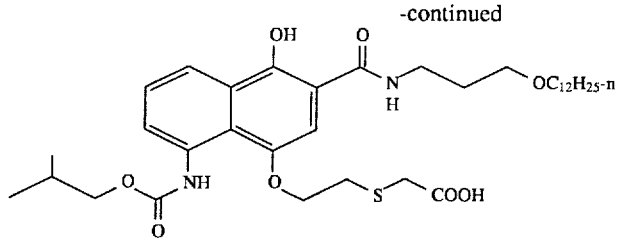
C-10
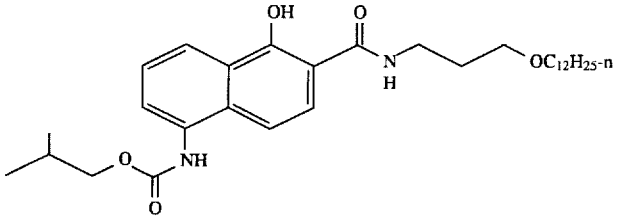
C-11
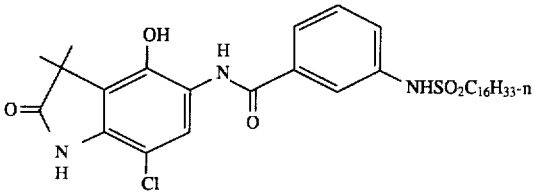
C-12
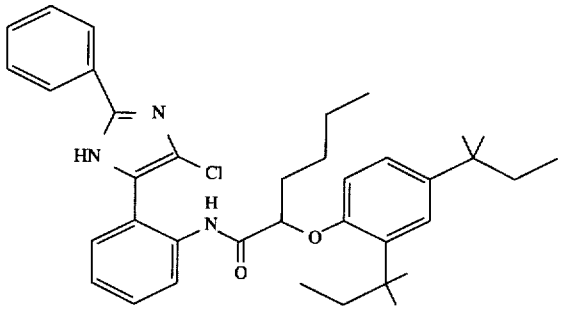
C-13
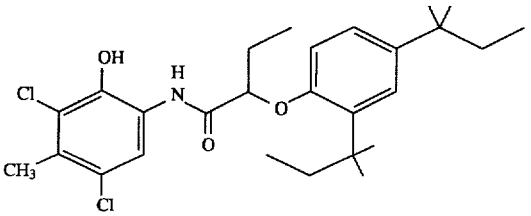
M-1
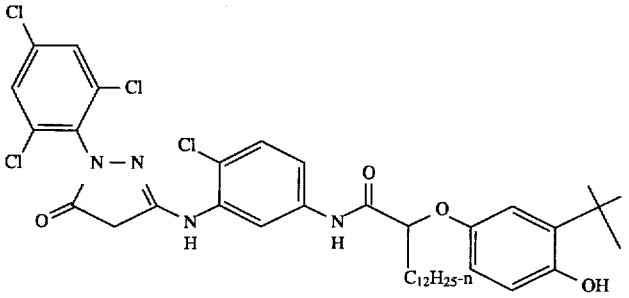

-continued
M-2
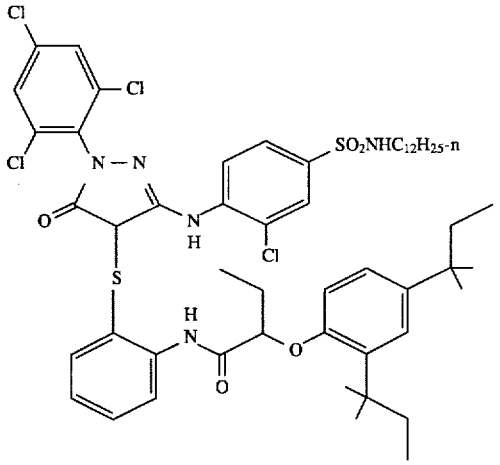
M-3
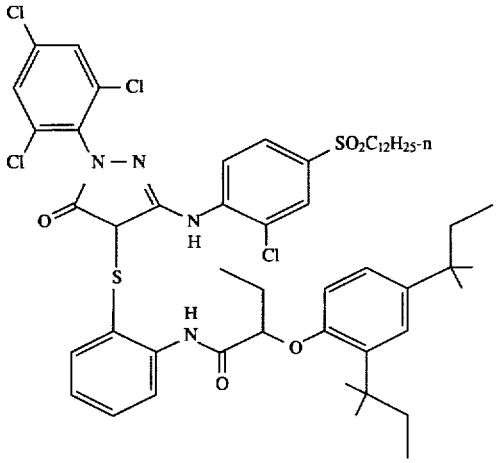
M-4
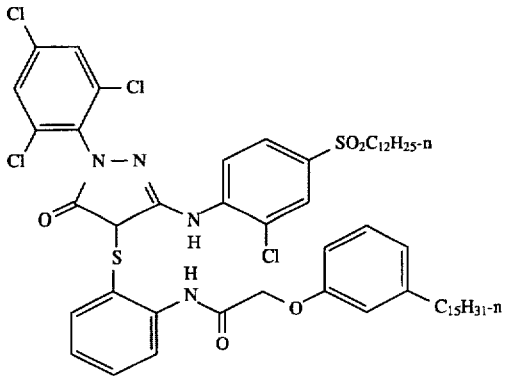

-continued
M-5
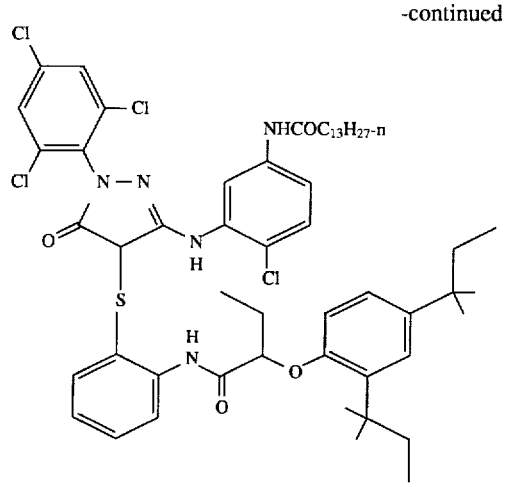
M-6
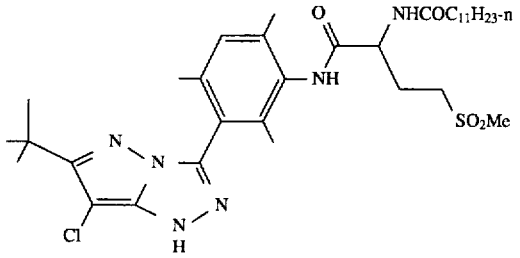
M-7
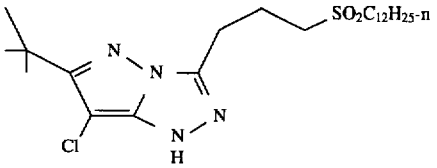
M-8
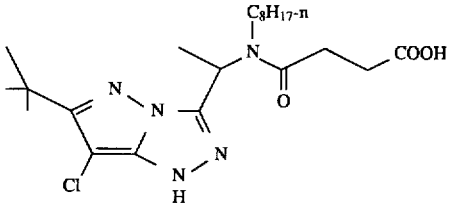
M-9
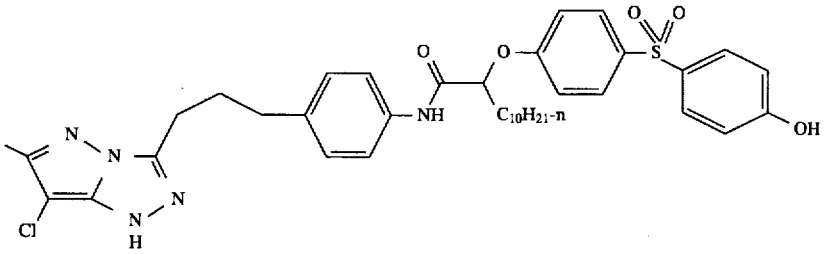

-continued
M-10
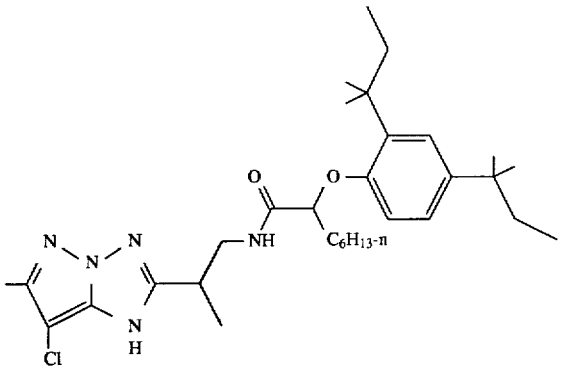
M-11
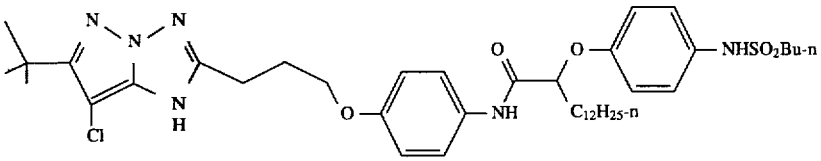
M-12
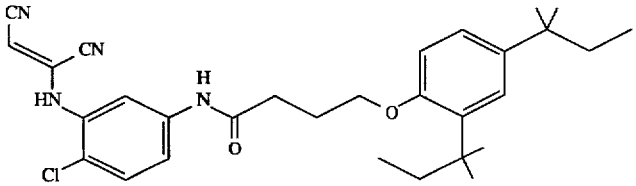
Y-1
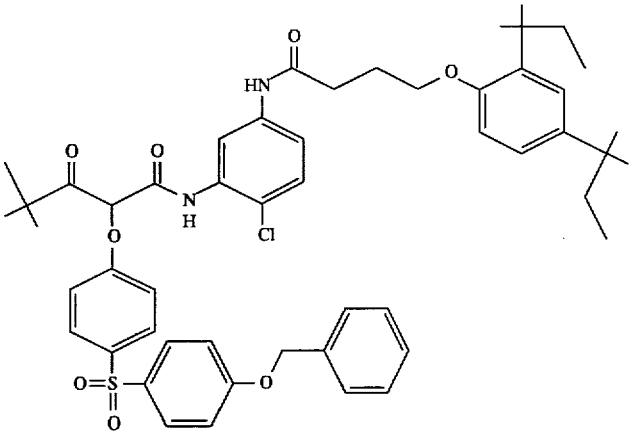
Y-2
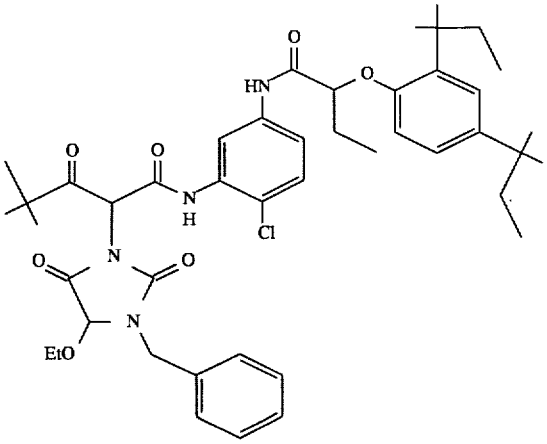

-continued
Y-3
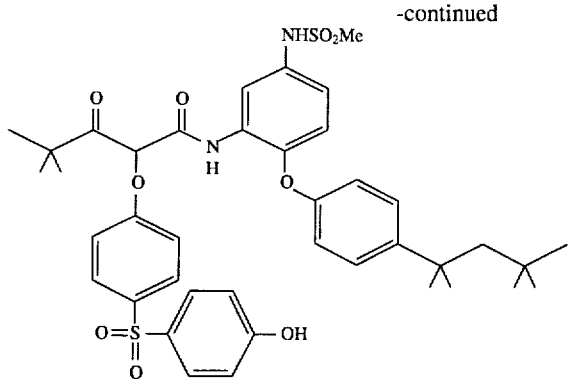
Y-4
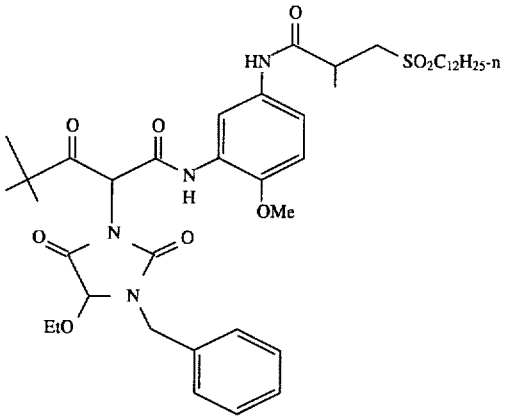
Y-5
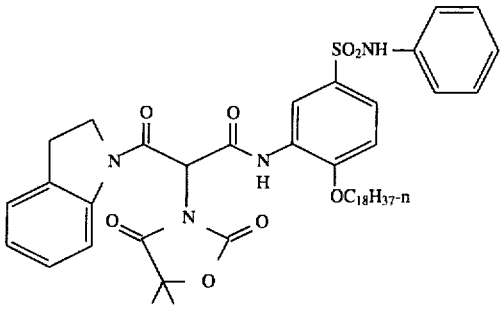
Y-6
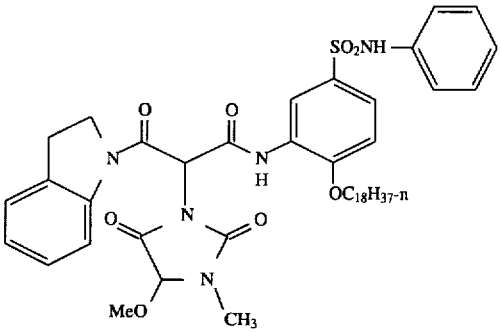

-continued
Y-7
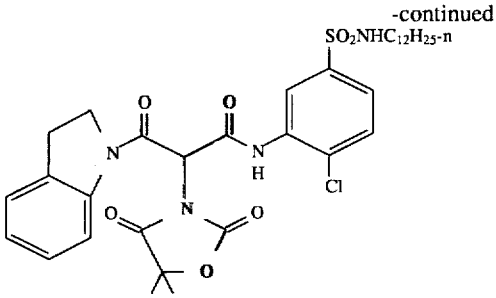
Y-8
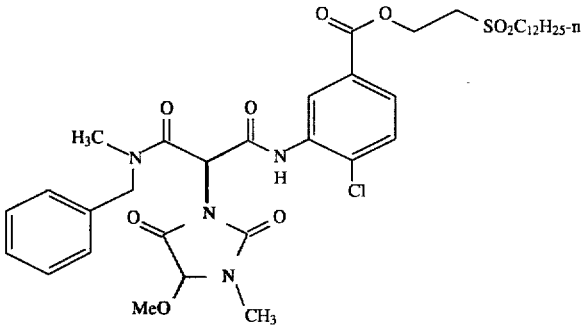
Y-9
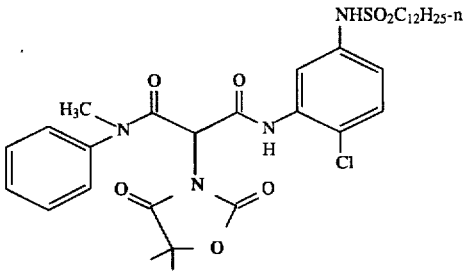
Y-10
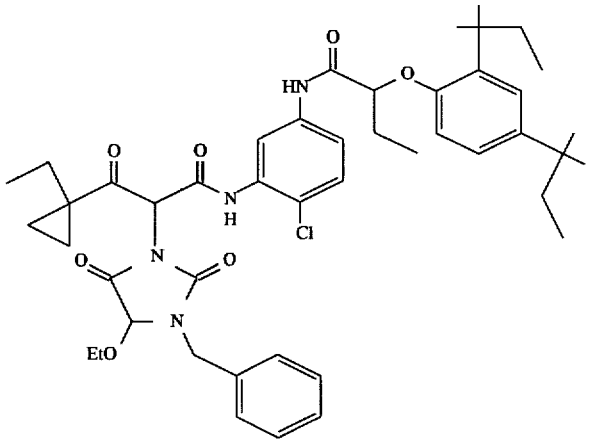
Y-11
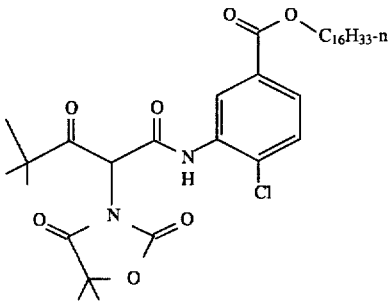

-continued
Y-12
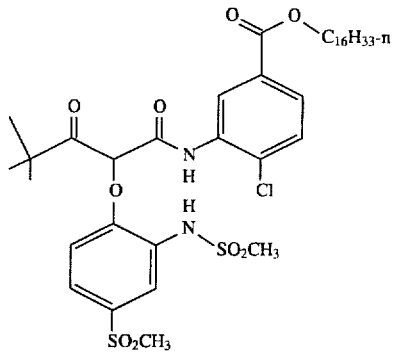
Y-13
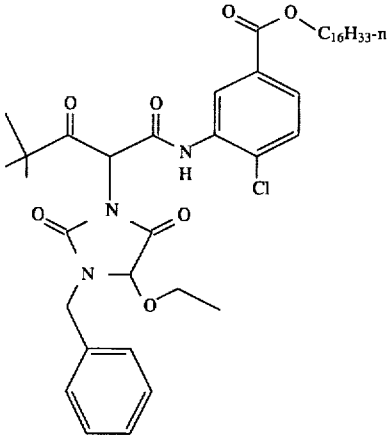
Y-14
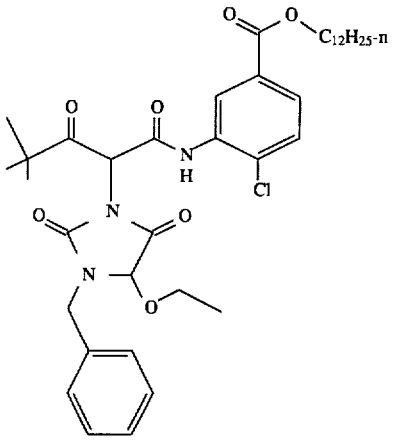
Y-15
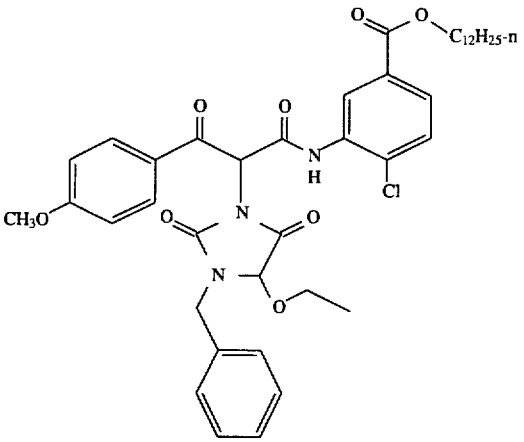

-continued

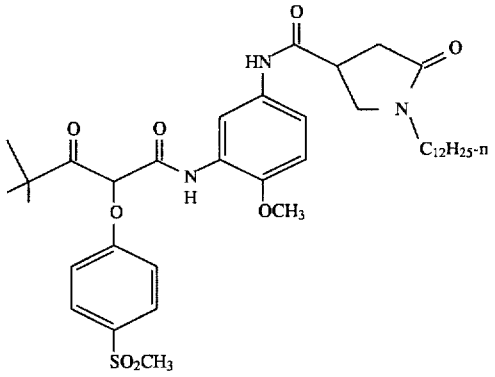

Y-16

The invention materials may also be used in association with materials that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; U.K. Patent 2,131,188); electron transfer agents (U.S. Pat. Nos. 4,859,578 and 4,912,025); antifogging and anti color-mixing agents such as derivatives of hydroquinones, aminophenols, amines, gallic acid; catechol; ascorbic acid; hydrazides; sulfonamidophenols; and non color-forming couplers.

Suitable hydroquinone color fog inhibitors include, but are not limited to compounds disclosed in EP 69,070; EP 98,241; EP 265,808; Japanese Published Patent Applications 61/233,744; 62/178,250; and 2/178,257. In addition, specifically contemplated are 1,4-benzenedipentanoic acid, 2,5-dihydroxy-delta,delta,delta',delta'-tetramethyl-, dihexyl ester; 1,4-Benzenedipentanoic acid, 2-hydroxy-5-methoxy-delta,delta,delta',delta'-tetramethyl-, dihexyl ester; and 2,5-dimethoxy-delta,delta,delta',delta'-tetramethyl-, dihexyl ester. In addition, it is contemplated that materials of this invention may be used with so called liquid ultraviolet absorbers such as described in U.S. Pat. Nos. 4,992,358; 4,975,360; and 4,587,346.

Various kinds of discoloration inhibitors can be used in conjunction with elements of this invention. Typical examples of organic discoloration inhibitors include hindered phenols represented by hydroquinones, 6-hydroxychromans, 5-hydroxycoumarans, spirochromans, p-alkoxyphenols and bisphenols, gallic acid derivatives, methylenedioxybenzenes, aminophenols, hindered amines, and ether or ester derivatives obtained by silylation, alkylation or acylation of phenolic hydroxy groups of the above compounds. Also, metal complex salts represented by (bis-salicylaldoximato)nickel complex and (bis-N,N-dialkyldithiocarbamato)nickel complex can be employed as a discoloration inhibitor. Specific examples of the organic discoloration inhibitors are described below. For instance, those of hydroquinones are disclosed in U.S. Pat. Nos. 2,360,290; 2,418,613; 2,700,453; 2,701,197; 2,710,801; 2,816,028; 2,728,659; 2,732,300; 2,735,765; 3,982,944 and 4,430,425; and British Patent 1,363,921; and so on; 6-hydroxychromans, 5-hydroxycoumarans, spirochromans are disclosed in U.S. Pat. Nos. 3,432,300; 3,573,050; 3,574,627; 3,698,909 and 3,764,337; and Japanese Published Patent Application 2-152,225; and so on; spiroindanes are disclosed in U.S. Pat. No. 4,360,589; those of p-alkoxyphenols are disclosed in U.S. Pat. No. 2,735,765; British Patent 2,066,975; Japanese Published Patent Applications 59-010,539 and 57-019,765; and so on; hindered phenols are disclosed, for example, in U.S. Pat. No. 3,700,455; 4,228,235; Japanese Published Patent Applications 52-072,224 and 52-006,623; and so on; gallic acid derivatives, methylenedioxybenzenes and aminophenols are disclosed in U.S. Pat. Nos. 3,457,079; 4,332,886; and Japanese Published Patent Application 56-021,144, respectively; hindered amines are disclosed in U.S. Pat. Nos. 3,336,135; 4,268,593; British Patents 1,326,889; 1,354,313 and 1,410,846; Japanese Published Patent Applications 51-001,420; 58-114,036; 59-053,846; 59-078,344; and so on; those of ether or ester derivatives of phenolic hydroxy groups are disclosed in U.S. Pat. Nos. 4,155,765; 4,174,220; 4,254,216; 4,279,990; Japanese Published Patent Applications 54-145,530; 55-006,321; 58-105,147; 59-010,539; 57-037,856; 53-003,263 and so on; and those of metal complexes are disclosed in U.S. Pat. Nos. 4,050,938 and 4,241,155.

Stabilizers that can be used with the invention include but are not limited to the following.

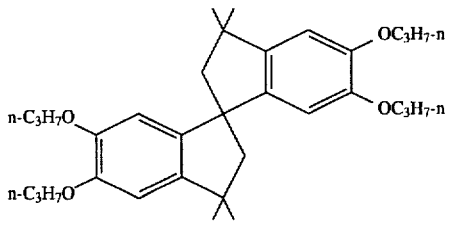

ST-1

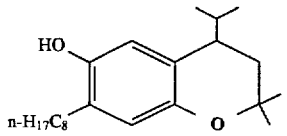

ST-2

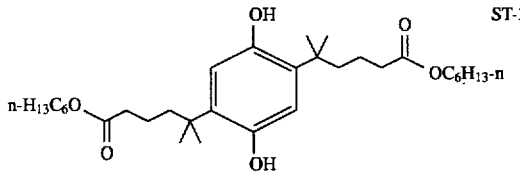

ST-3

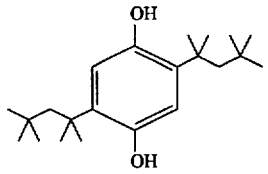

ST-4

-continued

ST-5

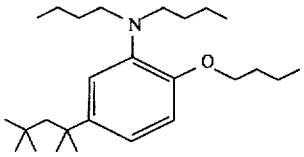

ST-6

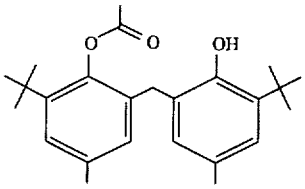

ST-7

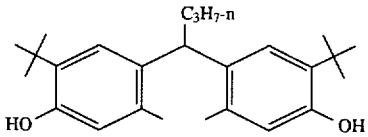

ST-8

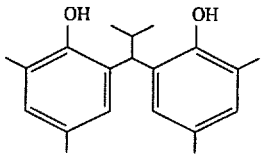

ST-9

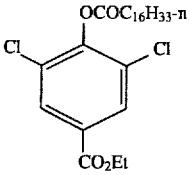

ST-10

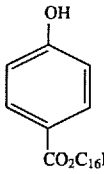

ST-11

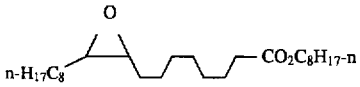

ST-12

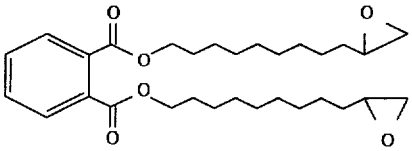

ST-13

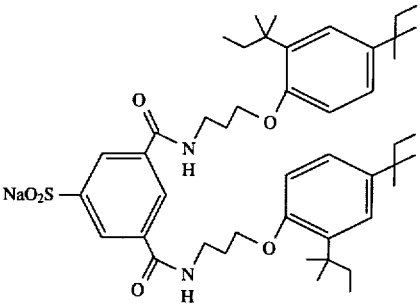

-continued

ST-14

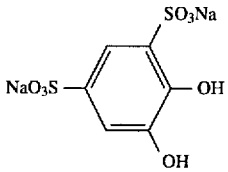

ST-15

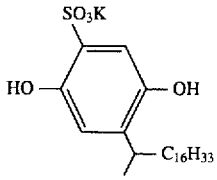

ST-16

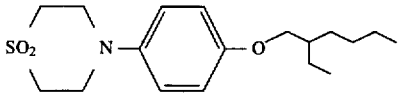

ST-17

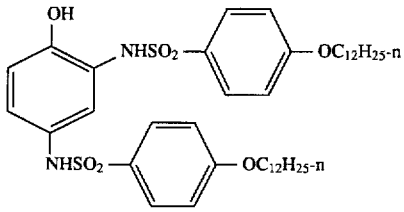

ST-18

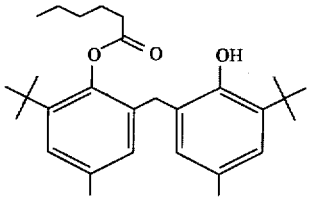

In a preferred embodiment of the invention, a bisphenol stabilizer, such as ST-6, ST-7, ST-8, or ST-18, is combined with a yellow dye forming coupler in a loaded latex dispersion of the invention. Such combinations have been found to possess particularly advantageous light stability.

The liquid organic, or oil phase, components of the dispersions of the invention may also include high-boiling or permanent organic solvents. High boiling solvents have a boiling point sufficiently high, generally above 150° C. at atmospheric pressure, such that they are not evaporated under normal dispersion making and photographic layer coating procedures. Non-limitive examples of high boiling organic solvents that may be used include the following.

| | |
|---|---|
| S-1 | Dibutyl phthalate |
| S-2 | Tritolyl phosphate |
| S-3 | N,N-Diethyldodecanamide |
| S-4 | Tris(2-ethylhexyl)phosphate |
| S-5 | Octyl oleate monoepoxide |
| S-6 | 2,5-Di-t-pentylphenol |
| S-7 | Acetyl tributyl citrate |
| S-8 | 1,4-Cyclohexylenedimethylene bis(2-ethylhexanoate) |
| S-9 | Bis(2-ethylhexyl) phthalate |
| S-10 | 2-phenylethyl benzoate |
| S-11 | Dibutyl sebacate |
| S-12 | N,N-Dibutyldodecanamide |
| S-13 | Oleyl alcohol |
| S-14 | 2-(2-Butoxyethoxy)ethyl acetate |

It is an advantage of the process of the invention that auxiliary solvents are not essential for this process, and it is preferred that they not be included. Inclusion of such solvents, however, may be desirable to achieve photographic properties not directly related to the dispersion making process, and their presence will not interfere with the process of the invention. Most useful auxiliary solvents are water immiscible, volatile solvents, and solvents with limited water solubility which are not completely water miscible. Non-limitive examples of these include the following.

| | |
|---|---|
| A-1 | Ethyl acetate |
| A-2 | Cyclohexanone |
| A-3 | 4-Methyl-2-pentanol |
| A-4 | Triethyl phosphate |
| A-5 | Methylene chloride |
| A-6 | Tetrahydrofuran |

The dispersions of the invention may also include UV stabilizers. Examples of UV stabilizers are shown below.

UV-1

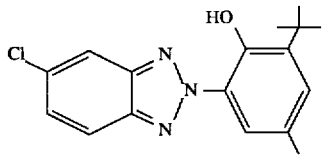

UV-2

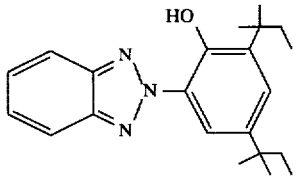

UV-3

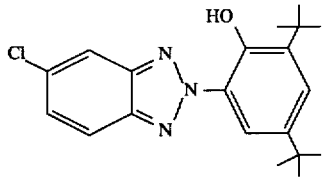

UV-4

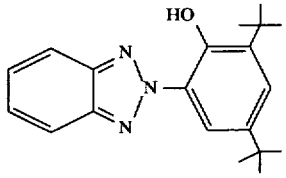

UV-5

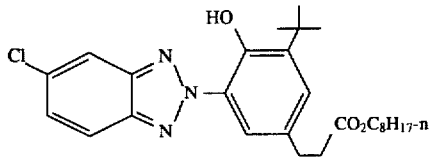

UV-6

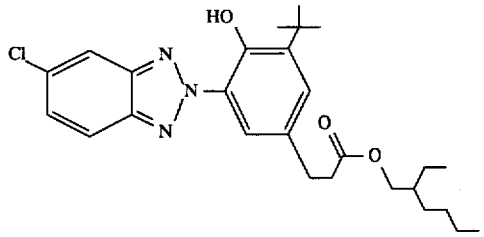

UV-7

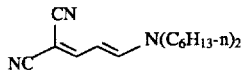

-continued

UV-8

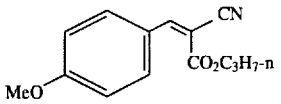

The aqueous phase of the dispersions of the invention may comprise a hydrophilic colloid, preferably gelatin. This may be gelatin or a modified gelatin such as acetylated gelatin, phthalated gelatin, oxidized gelatin, etc. Gelatin may be base-processed, such as lime-processed gelatin, or may be acid-processed, such as acid processed ossein gelatin. The hydrophilic colloid may be another water-soluble polymer or copolymer including, but not limited to poly(vinyl alcohol), partially hydrolyzed poly(vinylacetate/vinylalcohol), hydroxyethyl cellulose, poly(acrylic acid), poly(1-vinylpyrrolidone), poly(sodium styrene sulfonate), poly(2-acrylamido-2-methane sulfonic acid), polyacrylamide. Copolymers of these polymers with hydrophobic monomers may also be used.

The aqueous phase may include surfactants. Surfactants may be cationic, anionic, zwitterionic or non-ionic. In a preferred embodiment of the invention, the loaded latex dispersions are formed in the presence of anionic and/or nonionic surfactants. Ratios of surfactant to liquid organic solution typically are in the range of 0.5 to 25 wt. % for forming small particle photographic dispersions, which ratios are also useful for the invention dispersions. Useful surfactants include, but are not limited the following.

F-1

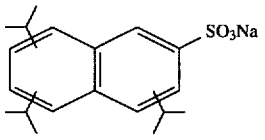

F-2 $CF_3-(CF_2)_7-SO_3Na$

F-3 $CH_3-(CH_2)_n-SO_3Na$ n = 12–14

F-4

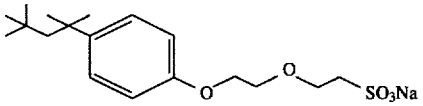

F-5 $CH_3-(CH_2)_{11}-OSO_3Na$

F-6

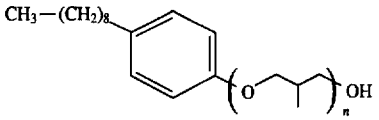

n = ca. 10

F-7

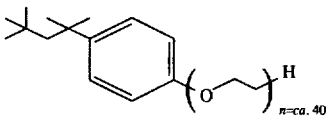

F-8

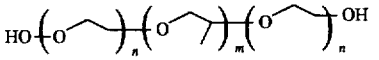

n = ca. 6
m = ca. 22

F-9

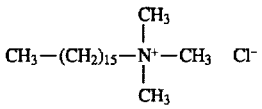

F-10

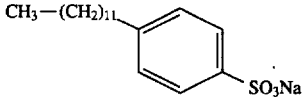

-continued

F-11

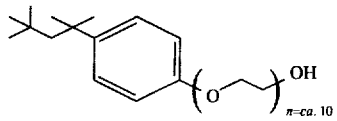

Devices suitable for the high-shear or turbulent mixing of the dispersions of the invention include those generally suitable for preparing submicron photographic emulsified dispersions. These include but are not limited to blade mixers, devices in which a liquid stream is pumped at high pressure through an orifice or interaction chamber, sonication, Gaulin mills, homogenizers, blenders, etc. More than one type of device may be used to prepare the dispersions. For the purposes of this invention, "high shear or turbulent conditions" defines shear and turbulence conditions sufficient to generate a small particle conventional photographic dispersion of a coupler with a coupler solvent, such as the formulation of Dispersion 101 of Example 3 below, with an average particle size of less than about 0.4 micron.

Preferred latex polymers of the invention include addition polymers prepared by emulsion polymerization. Especially preferred are polymers prepared as latex with essentially no water-miscible or volatile solvent added to the monomer. Also suitable are dispersed addition or condensation polymers, prepared by emulsification of a polymer solution, or self-dispersing polymers.

Especially preferred latex polymers include those prepared by free-radical polymerization of vinyl monomers in aqueous emulsion. Polymers comprising monomers which form water-insoluble homopolymers are preferred, as are copolymers of such monomers, which may also comprise monomers which give water-soluble homopolymers, if the overall polymer composition is sufficiently water-insoluble to form a latex.

Examples of suitable monomers include allyl compounds such as allyl esters (e.g., allyl acetate, allyl caproate, etc.); vinyl ethers (e.g., methyl vinyl ether, butyl vinyl ether, methoxyethyl vinyl ether, ethoxyethyl vinyl ether, chloroethyl vinyl ether, 1-methyl-2,2-dimethylpropyl vinyl ether, hydroxyethyl vinyl ether, diethylene glycol vinyl ether, dimethylaminoethyl vinyl ether, butylaminoethyl vinyl ether, benzyl vinyl ether, tetrahydrofurfuryl vinyl ether, etc.); vinyl esters (such as vinyl acetate, vinyl propionate, vinyl butyrate, vinyl isobutyrate, vinyl dimethyl propionate, vinyl ethyl butyrate, vinyl chloroacetate, vinyl dichloroacetate, vinyl methoxyacetate, vinyl phenyl acetate, vinyl acetoacetate, etc.); vinyl heterocyclic compounds (such as N-vinyl oxazolidone, N-vinylimidazole, N-vinylpyrrolidone, N-vinylcarbazole, vinyl thiophene, N-vinylethyl acetamide, etc.); styrenes (e.g, styrene, divinylbenzene, methylstyrene, dimethylstyrene, ethylstyrene, isopropylstyrene, sodium styrenesulfonate, potassium styrenesulfinate, butylstyrene, hexylstyrene, cyclohexylstyrene, benzylstyrene, chloromethylstyrene, trifluoromethylstyrene, acetoxymethylstyrene, acetoxystyrene, vinylphenol, (t-butoxycarbonyloxy) styrene, methoxystyrene, 4-methoxy-3-methylstyrene, dimethoxystyrene, chlorostyrene, dichlorostyrene, trichlorostyrene, bromostyrene, iodostyrene, fluorostyrene, methyl vinylbenzoate ester, vinylbenzoic acid, etc.); crotonic acids (such as crotonic acid, crotonic acid amide, crotonate esters (e.g., butyl crotonate, etc.)); vinyl ketones (e.g., methyl vinyl ketone, etc ); olefins (e.g., dicyclopentadiene, ethylene, propylene, 1-butene, 5,5-dimethyl-1-octene, etc.); itaconic acids and esters (e.g., itaconic acid, methyl itaconate, etc.), other acids such as sorbic acid, cinnamic acid, methyl sorbate, citraconic acid, chloroacrylic acid mesaconic acid, maleic acid, fumaric acid, and ethacrylic acid; halogenated olefins (e.g., vinyl chloride, vinylidene chloride, etc.); unsaturated nitriles (e.g., acrylonitrile, etc.); acrylic or methacrylic acids and esters (such as acrylic acid, methyl acrylate, methacrylic acid, methyl methacrylate, ethyl acrylate, butyl acrylate, butyl methacrylate, 2-hydroxyethyl methacrylate, 2-acetoacetoxyethyl methacrylate, sodium-2-sulfoethyl acrylate, 2aminoethylmethacrylate hydrochloride, glycidyl methacrylate, ethylene glycol dimethacrylate, etc.); and acrylamides and methacrylamides (such as acrylamide, methacrylamide, N-methylacrylamide, N,N-dimethylacrylamide, N-isopropylacrylamide, N-s-butylacrylamide, N-t-butylacrylamide, N-cyclohexylacrylamide, N-(3-aminopropyl)methacrylamide hydrochloride, N-(3-dimethylaminopropyl)methacrylamide hydrochloride, N,N-dipropylacrylamide, N-(1,1-dimethyl-3-oxobutyl)acrylamide, N-(1,1,2-trimethylpropyl)acrylamide, N-(1,1,3,3-tetramethylbutyl)acrylamide, N-(1-phthalamidomethyl)acrylamide, sodium N-(1,1-dimethyl-2-sulfoethyl)acrylamide, N-butylacrylamide, N-(1,1-dimethyl-3-oxobutyl)acrylamide, N-(2-carboxyethyl)acrylamide, 3-acrylamido-3-methylbutanoic acid, methylene bisacrylamide, etc.).

In a preferred embodiment of the invention, the latex polymer comprises at least about 50% N-alkylacrylamide monomer units, where the alkyl substituent preferably has from 3–8 carbon atoms, such as N-tert-butylacrylamide units, which impart particularly desirable photographic performance in the elements of the invention. Polymers of similarly high glass transition temperature (Tg), e.g., higher than 60° C. and more preferably higher than 90° C., are also particularly preferred.

Latex polymers generally comprise polymer particles having an average particle diameter of from about 0.02 to 2.0 microns. In a preferred embodiment B5 of the invention, latex particles having an average diameter of from about 0.03 to 0.5 microns are used in the dispersions of the invention. In a more preferred embodiment, latex particles having an average diameter of from about 0.03 to 0.2 microns are used.

The latex polymer average molecular weight generally ranges from about 1000 to 5,000,000 in non-crosslinked form. In a preferred embodiment of the invention, loaded latex dispersions of latex particles having an average molecular weight of from about 300,000 to 5,000,000 are formed. Dispersions with polymers having high molecular weight such as these are not easily formed by prior processes wherein a solution containing the polymer is emulsified and dispersed. In accordance with a further embodiment of the invention, where the latex polymers comprise crosslinked polymers, their molecular weight may far exceed 5,000,000.

Specific examples of useful polymer latex materials are given below. Copolymer ratios indicated are weight ratios unless otherwise specified.

P-1 Poly(N-tert-butylacrylamide) Tg~146° C.
P-2 Poly(N-cyclohexylamide)
P-3 Poly(N-sec-butylacrylamide)
P-4 Poly(N-(1,1,3,3-tetramethylbutyl)acrylamide)
P-5 Poly(N-(1,1,2-trimethylpropyl)acrylamide)
P-6 Poly(N-(1,1-dimethyl-3-oxobutyl)acrylamide)
P-7 Poly(N-(1-phthalimidomethyl)acrylamide)
P-8 Poly(N,N-di-n-propylacrylamide)
P-9 N-tert-butylacrylamide/2-hydroxyethylmethacrylate copolymer (80/20)
P-10 N-tert-butylacrylamide/methylene bisacrylamide copolymer (98/2)

P-11 N-cyclohexylacrylamide/methylene bisacrylamide copolymer (98/2)

P-12 1,1-dimethyl-3-oxobutyl)acrylamide/methylene bisacrylamide copolymer (98/2)

P-13 Methyl acrylate/2-acrylamido-2-methylpropane sulfonic acid copolymer (96/4)

P-14 Methyl acrylate/2-acrylamido-2-methylpropane sulfonic acid copolymer (98/2)

P-15 Methyl acrylate/2-acrylamido-2-methylpropane sulfonic acid/2-acetoacetoxyethyl methacrylate copolymer (91/5/4) Tg~24° C.

P-16 Methyl acrylate/2-acrylamido-2-methylpropane sulfonic acid/ethylene glycol dimethacrylate copolymer (96/2/2)

P-17 Butyl acrylate/2-acrylamido-2-methylpropane sulfonic acid sodium salt/2-acetoacetoxyethyl methacrylate copolymer (90/6/4) Tg—42° C.

P-18 Butyl acrylate/2-acrylamido-2-methylpropane sulfonic acid/ethylene glycol dimethacrylate copolymer (90/6/4)

P-19 Butyl acrylate/styrene/methacrylamide/2-acrylamido-2-methylpropane sulfonic acid sodium salt copolymer (55/29/11/5)

P-20 Butyl acrylate/styrene/2-acrylamido-2-methylpropane sulfonic acid sodium salt copolymer (85/10/5)

P-21 Poly(butyl acrylate)

P-22 Poly(hexyl acrylate)

P-23 Poly(butyl methacrylate)

P-24 Poly(hexyl methacrylate)

P-25 Poly(vinylidene chloride)

P-26 Poly(vinyl chloride)

P-27 Styrene/vinyl acetate copolymer (1/1 molar)

P-28 Styrene/methyl vinyl ether copolymer (1/1 molar)

P-29 Ethylene/vinyl acetate copolymer (1/1 molar)

P-30 Poly(glycidyl methacrylate)

P-31 Poly(methyl methacrylate) Tg~110° C.

P-32 Glycidyl methacrylate/ethylene glycol dimethacrylate copolymer (95/5)

P-33 Poly(acrylonitrile)

P-34 Acrylonitrile/vinylidene chloride/acrylic acid copolymer (15/79/6)

P-35 Styrene/butyl methacrylate/2-sulfoethyl methacrylate sodium salt copolymer (30/60/10)

P-36 Polystyrene

P-37 Poly(4-acetoxystyrene)

P-38 Poly(4-vinylphenol)

P-39 Poly(4-t-butoxycarbonyloxystyrene)

P-40 2-(2'-Hydroxy-5'-methacrylyloxyethylphenyl)-2H-benzotriazole/ethyl acrylate/2-acrylamido-2-methylpropane sulfonic acid sodium salt copolymer (74/23/3)

P-41 N-tert-butylacrylamide/3-acrylamido-3-methylbutanoic acid copolymer (99.5/0.5)

P-42 N-tert-butylacrylamide/3-acrylamido-3-methylbutanoic acid copolymer (99.0/1.0)

P-43 N-tert-butylacrylamide/3-acrylamido-3-methylbutanoic acid copolymer (98/2)

P-44 N-tert-butylacrylamide/3-acrylamido-3-methylbutanoic acid copolymer (96/4)

P-45 N-tert-butylacrylamide/3-acrylamido-3-methylbutanoic acid copolymer (92/8)

P-46 N-tert-butylacrylamide/methyl acrylate copolymer (25/75)

P-47 N-tert-butylacrylamide/methyl acrylate copolymer (50/50)

P-48 N-tert-butylacrylamide/methyl acrylate copolymer (75/25)

P-49 Poly(methyl acrylate)

P-50 Methyl methacrylate/methyl acrylate copolymer (75/25)

P-51 Methyl methacrylate/methyl acrylate copolymer (50/50)

P-52 Methyl methacrylate/methyl acrylate copolymer (25/75)

P-53 N-tert-butylacrylamide/2-acrylamido-2-methylpropane sulfonic acid sodium salt copolymer (98/2)

P-54 N-tert-butylacrylamide/2-acrylamido-2-methylpropane sulfonic acid sodium salt copolymer (99/1)

P-55 Methyl methacrylate/2-acrylamido-2-methylpropane sulfonic acid sodium salt copolymer (98/2)

Suitable free-radical initiators for the polymerization include, but are not limited to the following compounds and classes. Inorganic salts suitable as initiators include potassium persulfate, sodium persulfate, potassium persulfate with sodium sulfite, etc. Peroxy compounds which may be used include benzoyl peroxide, t-butyl hydroperoxide, cumyl hydroperoxide, etc. Azo compounds which may be used include azobis(cyanovaleric acid), azobis(isobutyronitrile), 2,2'-azobis(2-amidinopropane) dihydrochloride, etc.

The latex polymers may additionally comprise photographically useful groups covalently bonded thereto, such as groups which function as photographic couplers, (including yellow, magenta and cyan image-forming couplers, colored or masking couplers, inhibitor-releasing couplers, and bleach accelerator-releasing couplers, dye-releasing couplers, etc.), UV absorbers, dyes, reducing agents (including oxidized developer scavengers and nucleators), stabilizers (including image stabilizers, stain-control agents, and developer scavengers), developing agents, optical brighteners, lubricants, etc.

The process of the invention is generally applicable to a wide range of latex polymer to loaded liquid organic solution weight ratios. Preferred loading ratios are from about 50:1 to 1:20, more preferred ratios being from about 10:1 to 1:10. Advantaged photographic performance is often seen with ratios from 1:1 to 1:5, particularly for loaded latex dispersions of image forming couplers. These higher ratios of liquid organic solution to polymer are not often readily prepared by prior latex loading procedures.

The photographic elements comprising the dispersions of the invention can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. In a preferred embodiment, the loaded latex dispersions of the invention are used in a photographic element that may be displayed for extended periods under illuminated conditions, such as a color paper photographic element which comprises photographic layers coated on a reflective support.

If desired, the photographic element can be used in conjunction with an applied magnetic layer as described in *Research Disclosure*, November 1992, Item 34390 published by Kenneth Mason Publications, Ltd., Dudley House, 12 North Street, Emsworth, Hampshire P010 7DQ, ENGLAND.

In the following discussion of suitable materials for use in the emulsions and elements that can be used in conjunction with this photographic element, reference will be made to *Research Disclosure*, September 1994, Item 36544, available as described above, which will be identified hereafter by the term "*Research Disclosure*." The contents of the *Research Disclosure*, including the patents and publications referenced therein, are incorporated herein by reference, and the Sections hereafter referred to are Sections of the *Research Disclosure*, Item 36544.

The silver halide emulsions employed in these photographic elements can be either negative-working or positive-working. Suitable emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing can be found in Sections XI–XX.

It is also contemplated that the materials and processes described in an article titled "Typical and Preferred Color Paper, Color Negative, and Color Reversal Photographic Elements and Processing," published in Research Disclosure, February 1995, Volume 370 may also be advantageously used with elements of the invention.

Various types of hardeners are useful in conjunction with elements of the invention. In particular, bis(vinylsulfonyl) methane, bis(vinylsulfonyl) methyl ether, 1,2-bis(vinylsulfonyl-acetamido) ethane, 2,4-dichloro-6-hydroxy-s-triazine, triacryloyltriazine, and pyridinium, 1-(4-morpholinylcarbonyl)-4-(2-sulfoethyl)-, inner salt are particularly useful. Also useful are so-called fast acting hardeners as disclosed in U.S. Pat. Nos. 4,418,142; 4,618,573; 4,673,632; 4,863,841; 4,877,724; 5,009,990; 5,236,822.

In a color negative element, it is contemplated to use the invention in conjunction with a photographic element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3-((2-(4-ethoxy-2,5-dioxo-3-(phenylmethyl)-1-imidazolidinyl)-3-(4-methoxyphenyl)-1, 3- dioxopropyl)amino)-, dodecyl ester and a slow yellow layer containing the same compound together with "Coupler 2": Propanoic acid, 2-[[5-[[4-[2-[[[2,4-bis (1,1-dimethylpropyl)phenoxy]acetyl ]amino]-5-[(2,2,3,3,4,4,4-heptafluoro-1-oxobutyl)amino]-4-hydroxyphenoxy]-2,3-dihydroxy-6-[(propylamino)carbonyl]phenyl] thio]- 1,3,4-thiadiazol-2-yl]thio]-, methyl ester and "Coupler 3": 1-((dodecyloxy)carbonyl) ethyl(3-chloro-4-((3-(2-chloro-(4-(1-tridecanoylethoxy)carbonyl)anilino)-3-oxo-2-((4)(5)(6)-(phenoxycarbonyl)-1H-benzotriazol-1-yl) propanoyl)amino))benzoate;

(3) an interlayer containing fine metallic silver;

(4) a triple-coat magenta pack with a fast magenta layer containing "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-,"Coupler 5": Benzamide, 3-((2-(2,4-bis(1,1-dimethylpropyl)phenoxy)-1-oxobutyl)amino)-N-(4',5'-dihydro-5'-oxo-1'-(2,4,6-trichlorophenyl) (1,4'-bi-1H-pyrazol)-3'-yl)-, "Coupler 6": Carbamic acid, (6-(((3-(dodecyloxy)propyl)amino)carbonyl)-5-hydroxy-1-naphthalanyl-, 2-methylpropyl ester, "Coupler 7": Acetic acid, ((2-((3-(((3-(dodecyloxy)propyl)amino) carbonyl)-4-hydroxy-8-(((2-methylpropoxy) carbonyl) amino)-1-naphthalenyl)oxy)ethyl)thio)-, and "Coupler 8": Benzamide, 3-((2-(2,4-bis(1,1-dimethylpropyl) phenoxy)-1-oxobutyl)amino)-N-(4,5-dihydro-4-((4-methoxyphenyl) azo)-5-oxo-1-(2,4,6-trichlorophenyl)-1H-pyrazol-3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6-trichlorophenyl)-4,5-dihydro-5-oxo-1H-pyrazol-3-yl]-2-methyl-2-propenamide; and "Coupler 10": Tetradecanamide, N-(4-chloro-3-((4-((4-((2,2-dimethyl-1-oxopropyl)amino)phenyl)azo)-4,5-dihydro-5-oxo-1-(2,4,6-trichlorophenyl)-1H-pyrazol-3-yl)amino)Phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1-dimethylpropyl)phenoxy)propyl)amino)carbonyl)-4-hydroxy-1-naphthalenyl)oxy)ethoxy)phenyl)azo)-4-hydroxy-, disodium salt; and a slow cyan layer containing Couplers 2 and 6;

(7) an undercoat layer containing Coupler 8; and (8) an antihalation layer.

Other color negative formats may employ the dispersions of the invention. Of particular interest are layer-thinned color negative film structures in which a smaller amount of gelatin is included in the coated layers.

In a reversal format, it is contemplated to use the invention in conjunction with an element comprising a support bearing the following layers from top to bottom:

(1) one or more overcoat layers;

(2) a nonsensitized silver halide containing layer;

(3) a triple-coat yellow layer pack with a fast yellow layer containing "Coupler 1": Benzoic acid, 4-(1-(((2-chloro-5-((dodecylsulfonyl)amino)phenyl) amino)carbonyl)-3,3-dimethyl-2-oxobutoxy)-, 1-methylethyl ester; a mid yellow layer containing Coupler 1 and "Coupler 2": Benzoic acid, 4-chloro-3-[[2-[4-ethoxy-2,5-dioxo-3-(phenylmethyl)-1-imidazolidinyl]-4,4-dimethyl-1,3-dioxopentyl]amino]-, dodecylester; and a slow yellow layer also containing Coupler 2;

(4) an interlayer;

(5) a layer of fine-grained silver;

(6) an interlayer;

(7) a triple-coated magenta pack with a fast magenta layer containing "Coupler 3": 2-Propenoic acid, butyl ester, polymer with N-[1-(2,5-dichlorophenyl)- 4,5-dihydro-5-oxo-1H-pyrazol-3-yl]-2-methyl-2-propenamide; "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-; and "Coupler 5": Benzamide, 3-(((2,4-bis(1,1-dimethylpropyl)phenoxy)acetyl)amino)-N-(4,5-dihydro-5-oxo-1-(2,4,6-trichlorophenyl)-1H-pyrazol-3-yl)-; and containing the stabilizer 1,1'-Spirobi(1H-indene), 2,2',3,3'-tetrahydro-3,3,3',3-tetramethyl-5,5', 6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2-cyanophenoxy)-N-(4-((2,2,3,3,4,4,4-heptafluoro-1-oxobutyl)amino)-3-hydroxyphenyl)-; a mid cyan containing "Coupler 7": Butanamide, N-(4-((2-(2,4-bis(1,1-dimethylpropyl)phenoxy)-1-oxobutyl)amino)-2-hydroxyphenyl)-2,2,3,3,4,4,4-heptafluoro- and "Coupler 8": Hexanamide, 2-(2,4-bis(1,1-dimethylpropyl)phenoxy)-N-(4-((2,2,3,3,4,4,4-heptafluoro-1-oxobutyl)amino)-3-hydroxyphenyl)-;

(10) one or more interlayers possibly including fine-grained nonsensitized silver halide; and

(11) an antihalation layer.

The invention may also be used in conjunction with the photograpic elements described in sections XVII–XIX and XXI of an article titled "Typical and Preferred Color Paper, Color Negative, and Color Reversal Photographic Elements and Processing," published in *Research Disclosure*, February 1995, Volume 370.

The invention may also be used in combination with photographic elements containing filter dye layers comprising colloidal silver sol or yellow, cyan, and/or magenta filter dyes, either as oil-in-water dispersions, latex dispersions or as solid particle dispersions. Additionally, they may be used with elements containing "smearing" couplers (e.g. as described in U.S. Pat. No. 4,366,237; EP 96,570; U.S. Pat. Nos. 4,420,556 and 4,543,323.) Also, the compositions may be blocked or coated in protected form as described, for example, in Japanese Application 61/258,249 or U.S. Pat. No. 5,019,492.

The invention materials may further be used in combination with a photographic element containing image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,9 37,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science*and *Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396; Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. Nos. 4,438,193 and 4,618,571) and groups that combine the features describe above. It is typical that the timing group or moiety is of one of the formulas:

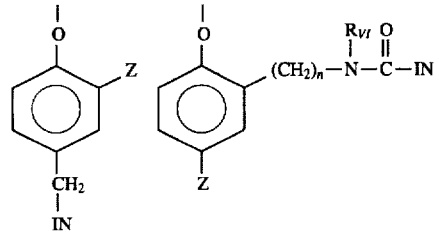

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1
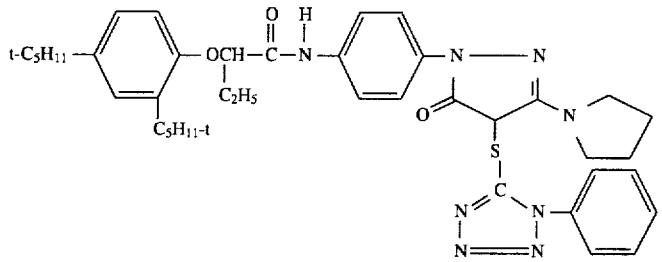
D2
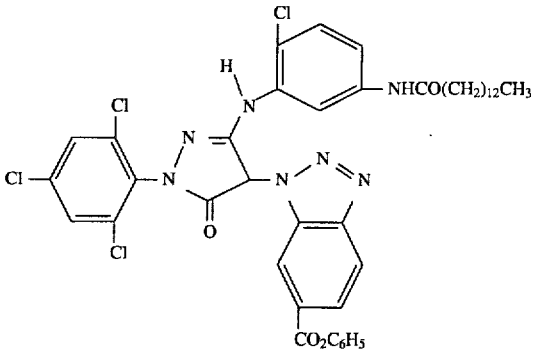
D3
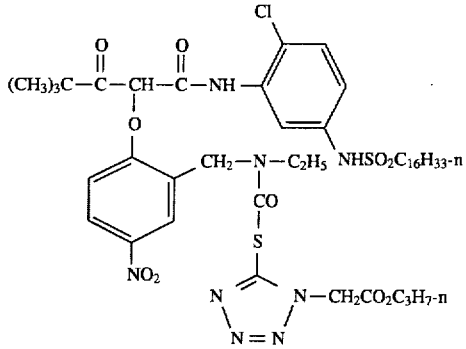
D4
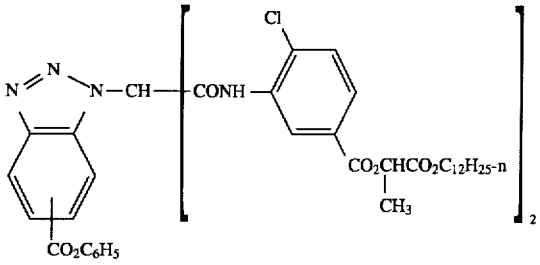
D5
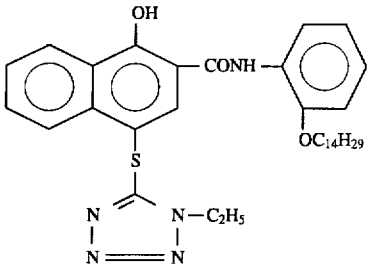

-continued
D6
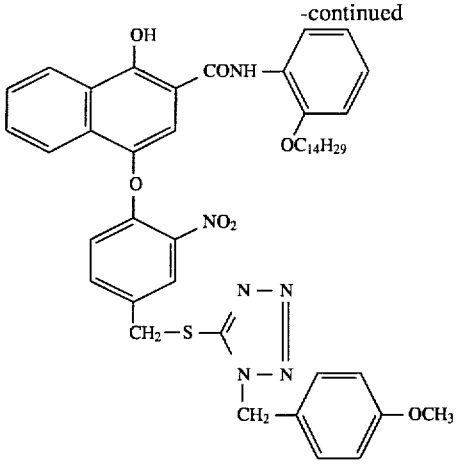
D7
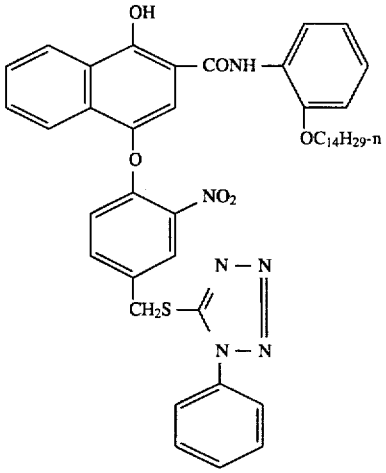
D8
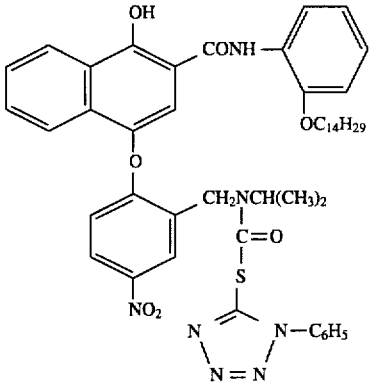

-continued

D9

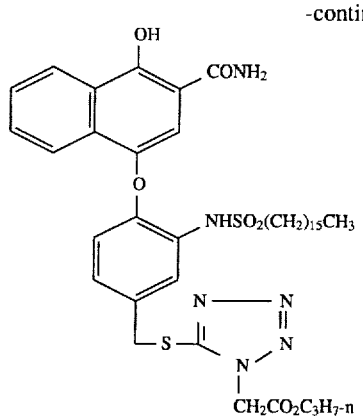

It is also contemplated that the concepts of the present invention may be employed to obtain reflection color prints as described in *Research Disclosure*, November 1979, Item 18716, incorporated herein by reference. Materials of the invention may be used in combination with a photographic element coated on pH adjusted support as described in U.S. Pat. No. 4,917,994; with a photographic element coated on support with reduced oxygen permeability (EP 553,339); with epoxy solvents (EP 164,961); with nickel complex stabilizers (U.S. Pat. Nos. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171.

Especially useful for use with this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micron) tabular grains. To achieve the lowest levels of granularity it is preferred that aim tabular grain projected areas be satisfied with ultrathin (t<0.06 micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069; and 5,061,616. In addition, use of [100] tabular grain silver chloride emulsions as described in U.S. Pat. No. 5,320,938 are specifically contemplated.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Due to a desire for rapid development, preferred emulsions for color paper are high in silver chloride. Typically, silver halide emulsions with greater than 90 mole % chloride are preferred, and even more preferred are emulsions of greater than 95 mole % chloride. In some instances, silver chloride emulsions containing small amounts of bromide, or iodide, or bromide and iodide are preferred, generally less than 5.0 mole % of bromide less than 2.0 mole % of iodide. Bromide or iodide addition when forming the emulsion may come from a soluble halide source such as potassium iodide or sodium bromide or an organic bromide or iodide or an inorganic insoluble halide such as silver bromide or silver iodide. Soluble bromide is also typically added to the emulsion melt as a keeping addendum.

Color paper elements typically contain less than 0.80 g/m$^2$ of total silver. Due to the need to decrease the environmental impact of color paper processing, it is desired to decrease the amount of total silver used in the element as much as possible. Therefore, total silver levels of less than 0.65 g/m$^2$ are preferable, and levels of 0.55 g/m$^2$ are even more preferable. It is possible to reduce further the total silver used in the color paper photographic element to less than 0.10 g/m$^2$ by use of a so-called development amplication process whereby the incorporated silver is used only to form the latent image, while another oxidant, such as hydrogen peroxide, serves as the primary oxidant to react with the color developer. Such processes are well-known to the art, and are described in, for example, U.S. Pat. No. 4,791,048; 4,880,725; and 4,954,425; EP 487,616; International published patent applications Nos. WO 90/013,059; 90/013,061; 91/016,666; 91/017,479; 92/001,972; 92/005,471; 92/007,299; 93/001,524; 93/011,460; and German published patent application OLS 4,211,460.

The emulsions can be spectrally sensitized with any of the dyes known to the photographic art, such as the polymethine dye class, which includes the cyanines, merocyanines, complex cyanines and merocyanines, oxonols, hemioxonols, styryls, merostyryls and streptocyanines. In particular, it would be advantageous to use the low staining sensitizing dyes disclosed in U.S. Pat. Nos. 5,316,904, 5,292,634, 5,354,651, and EP Patent Application 93/203193.3, in conjunction with elements of the invention.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The *British Journal of Photography Annual* of 1988, pages 191–198. Motion picture films may be processed as described in Kodak Publication No. H-24, Manual For Processing Eastman Color Films. Where applicable, the element may be processed in accordance with color print processes, such as the RA-4 process of Eastman Kodak Company as described in the *British Journal of Photography Annual* of 1988, pages 198–199, the Kodak Ektaprint 2 Process as described in Kodak Publication No. Z-122, using Kodak Ektaprint chemicals, and the Kodak ECP Process as described in Kodak Publication No. H-24, Manual For Processing Eastman Color Films. To provide a positive (or reversal) image, the color development step can be preceded by development with a non-chromogenic developing agent to develop exposed silver halide, but not form dye, and followed by uniformly fogging the element to render unexposed silver halide developable. For elements that lack incorporated dye image formers, sequential reversal color development with developers containing dye image formers such as color couplers is illustrated by the Kodachrome K-14 process (see U.S. Pat. Nos. 2,252,718; 2,950,970; and 3,547,650). For elements that contain incorporated color couplers, the E-6 color reversal process is described in the *British Journal of Photography Annual* of 1977, pages 194–197. Alternatively, a direct positive emulsion can be employed to obtain a positive image.

In these color photographic systems, the color-forming coupler is incorporated in the light-sensitive photographic emulsion layer so that during development, it is available in the emulsion layer to react with the color developing agent that is oxidized by silver image development. Diffusible couplers are used in color developer solutions. Non-diffusing couplers are incorporated in photographic emulsion layers. When the dye image formed is to be used in situ, couplers are selected which form non-diffusing dyes. For image-transfer color processes, couplers are used which will produce diffusible dyes capable of being mordanted or fixed in the receiving sheet. The invention can also be use in conjunction with color photographic systems which produce black-and-white images from non-diffusing couplers as described by Edwards et al in International Publication No. WO 93/012465.

Photographic color light-sensitive materials often utilize silver halide emulsions where the halide, for example chloride, bromide and iodide, is present as a mixture or combination of at least two halides. The combinations significantly influence the performance characteristics of the silver halide emulsion. As explained in Atwell, U.S. Pat. No. 4,269,927, silver halide with a high chloride content, that is, light-sensitive materials in which the silver halide grains are at least 80 mole percent silver chloride, possesses a number of highly advantageous characteristics. For example, silver chloride possesses less native sensitivity in the visible region of the spectrum than silver bromide, thereby permitting yellow filter layers to be omitted from multicolor photographic light-sensitive materials. However, if desired, the use of yellow filter layers should not be excluded from consideration for a light sensitive material. Furthermore, high chloride silver halides are more soluble than high bromide silver halide, thereby permitting development to be achieved in shorter times. Furthermore, the release of chloride into the developing solution has less restraining action on development compared to bromide and this allows developing solutions to be utilized in a manner that reduces the amount of waste developing solution.

Processing a silver halide color photographic light-sensitive material is basically composed of two steps of 1) color development (for color reversal light-sensitive materials, black-and-white first development is necessary) and 2) desilvering. The desilvering stage comprises a bleaching step to change the developed silver back to an ionic-silver state and a fixing step to remove the ionic silver from the light-sensitive material. The bleaching and fixing steps can be combined into a monobath bleach-fix step that can be used alone or in combination with the bleaching and the fixing step. If necessary, additional processing steps may be added, such as a washing step, a stopping step, a stabilizing step and a pretreatment step to accelerate development. The processing chemicals used may be liquids, pastes, or solids, such as powders, tablets or granules.

In color development, silver halide that has been exposed to light (or a reversal bath for color reversal) is reduced to silver, and at the same time, the oxidized aromatic primary amine color developing agent is consumed by the above mentioned reaction to form image dyes. In this process halide ions from the silver halide grains are dissolved into the developer, where they will accumulate. In addition the color developing agent is consumed by the afore-mentioned reaction of the oxidized color developing agent with the coupler. Furthermore, other components in the color developer will also be consumed and the concentration will gradually be lowered as additional development occurs. In a batch-processing method, the performance of the developer solution will eventually be degraded as a result of the halide ion build-up and the consumption of developer components. Therefore, in a development method that continuously processes a large amount of a silver halide photographic light-sensitive material, for example by automatic-developing processors, in order to avoid a change in the finished photographic characteristics caused by the change in the concentrations of the components, some means is required to keep the concentrations of the components of the color developer within certain ranges.

For instance, a developer solution in a processor tank can be maintained at a 'steady-state concentration' by the use of another solution that is called the replenisher solution. By metering the replenisher solution into the tank at a rate proportional to the amount of the photographic light-sensitive material being developed, components can be maintained at an equilibrium within a concentration range that will give good performance. For the components that are consumed, such as the developing agents and preservatives, the replenisher solution is prepared with the component at a concentration higher than the tank concentration. In some cases a material will leave the emulsions layers that will have an effect of restraining development, and will be present at a lower concentration in the replenisher or not present at all. In other cases a material may be contained in a replenisher in order to remove the influence of a materials that will wash out of the photographic light-sensitive material. In other cases, for example, the buffer, or the concentration of a chelating agent where there may be no consumption, the component in the replenisher is the same or similar concentration as in the processor tank. Typically the replenisher has a higher pH to account for the acid that is released during development and coupling reactions so that the tank pH can be maintained at an optimum value.

Similarly, replenishers are also designed for the secondary bleach, fixer and stabilizer solutions. In addition to additions for components that are consumed, components are added to compensate for the dilution of the tank which occurs when the previous solution is carried into the tank by the photographic light-sensitive material.

The following processing steps may be included in the preferable processing steps carried out in the method in which a processing solution is applied:

1) color developing→bleach-fixing→washing/stabilizing;
2) color developing→bleaching→fixing→washing/stabilizing;
3) color developing→bleaching→bleach-fixing →washing/stabilizing;
4) color developing→stopping→washing→bleaching→washing→fixing→washing/stabilizing;
5) color developing→bleach-fixing→fixing→washing/stabilizing;
6) color developing→bleaching→bleach-fixing →fixing→washing/stabilizing.

Among the processing steps indicated above, the steps 1), 2), 3), and 4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 92/09932; U.S. Pat. No. 5,294,956; EP 559,027; U.S. Pat. No. 5,179,404; EP 559,025; U.S. 5,270, 762; EP 559,026; U.S. Pat. No. 5,313,243; U.S. Pat. No. 5,339,131.

The color developing solution used with this photographic element may contain aromatic primary amine color developing agents, which are well known and widely used in a variety of color photographic processes. Preferred examples are p-phenylenediamine derivatives. They are usually added to the formulation in a salt form, such as the hydrochloride, sulfate, sulfite, p-toluene-sulfonate, as the salt form is more stable and has a higher aqueous solubility than the free amine. Among the salts listed the p-toluene-sulfonate is rather useful from the viewpoint of making a color developing agent highly concentrated. Representative examples are given below, but they are not meant to limit what could be used with the present photographic element:

4-amino-3-methyl-N-ethyl-N-(β-hydroxyethyl)aniline sulfate, 4-amino-3-methyl-N-ethyl-N-(β-(methanesulfonamido-ethyl)aniline sesquisulfate hydrate, 4-amino-N,N-diethylaniline hydrochloride, 4-amino-3-methyl-N,N-diethylaniline hydrochloride, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

EXAMPLES

Example 1

Synthesis of latex polymers

Synthesis example A: preparation of latex polymer P-1:

P-1a) t-Butylacrylamide (100 g, Chemie Linz) was slurried with vigorous mixing in a solution of water (234 g) and surfactant F-3 (12.5g of a 40% aqueous solution). This slurry was added in three portions at 7 minute intervals to an 80° C. stirred 1L Morton flask equipped with a condenser, under $N_2$ atmosphere, charged with water (150 g), surfactant F-3 (4.2 g of a 40% aqueous solution), and initiator (azobis(cyanovaleric acid) 75%, 1.0 g, Aldrich). The resulting translucent latex was stirred at 80° C. for an additional 3 h. The latex was cooled and filtered, yielding 494 g latex at 21.0% solids. Photon correlation spectroscopy showed an average particle size of 0.057 microns. A sample of the latex was freeze-dried. $^1$H NMR (300 MHz, $CDCl_3$), δ=1.15 (s, 9H), 1.2–2.2 (m, 3H), 5.6–6.5 (s, broad, 1H). Differential scanning calorimetry showed a $T_g$ of 146° C. Size exclusion chromatography (0.01M $LiNO_3$/N,N-dimethylformamide showed $M_w$=319,000, $M_n$=65,300. Inherent viscosity, (0.25%, ethyl acetate)=0.63.

P-1b) As for 1a, using one-half the surfactant F-3 (6.3 g with the monomer and 2.1 g in the reaction vessel, of a 40% aqueous solution). Yield 488 g latex, 20.9% solids. PCS showed an average particle size of 0.072 μm. $^1$H NMR was similar to 1a. $T_g$=146° C. (by Differential Scanning Calorimetry, (DSC)). SEC (0.01M $LiNO_3$/DMF), $M_w$=468,000, $M_n$=108,000. Inherent viscosity, (0.25%, ethyl acetate)=0.76

P-1c) As for 1a, using surfactant F-4 (8.80 g with the monomer and 2.93 g in the reaction vessel, of a 21.3% aqueous solution). Yield 483 g latex, 21.1% solids. PCS showed an average particle size of 0.110 μm. $^1$H NMR was similar to 1a. $T_g$=145° C. (DSC). SEC (0.01M $LiNO_3$/DMF), $M_w$=1,500,000, $M_n$=387,000. Inherent viscosity, (0.25%, ethyl acetate)=0.91.

P-1d) t-Butylacrylamide (1000 g, Chemie Linz) was slurried with vigorous mixing in a solution of water (2090 g) and surfactants F-3 (25.0 g of a 40% aqueous solution) and F-4 (112.5 g of a 10% aqueous solution). This slurry was pumped over ca. 2 h, (27 mL/min) into an 80° C. stirred 5L Morton flask equipped with a condenser, under $N_2$ atmosphere, charged with water (1170 g), surfactants F-3 (8.3 g of a 40% aqueous solution) and F-4 (37.5 g of 10% aqueous solution), and initiator (azobis(cyanovaleric acid) 75%, 5.0 g, Aldrich). The resulting translucent latex was stirred at 80° C. for an additional 15 h. The latex was cooled and filtered, yielding 4330 g latex at 23.4% solids. Photon correlation spectroscopy showed an average particle size of 0.067 microns. Inherent viscosity, (0.25%, ethyl acetate)=2.00.

Synthesis example B: preparation of latex polymer P11:

Cyclohexylacrylamide (98 g, Chemie Linz) and N,N'-methylenebisacrylamide (2.0 g, American Cyanamide) were combined with vigorous mixing in a solution of water (237 g) and surfactant F-4 (8.8 g of a 21.3% solution). The slurry was pumped over ca. 18 minutes (20 mL/min) into an 80° C. stirred Morton flask equipped with a condenser, under $N_2$ atmosphere, charged with water (150 g), surfactant F-4 (2.9 g of a 21.3% aqueous solution), and initiator (azobis(cyanovaleric acid) 75%, 1.0 g, Aldrich). The resulting latex was stirred at 80° C. for an additional 75 minutes. The latex was cooled and filtered, yielding 487 g latex at 20.34% solids. Photon correlation spectroscopy showed an average particle size of 0.107 microns.

Synthesis example C: preparation of latex polymer P16:

Methyl acrylate (96 g), ethylene glycol dimethacrylate (2.0 g) and 2-acrylamido-2-methyl propane sulfonic acid, sodium salt (3.45 of a 58% solution) were combined with water (237 g) and surfactant F-4 (8.8 g of a 21.3% aqueous solution). The monomer emulsion was pumped over ca. 18 minutes (20 mL/min) into an 80° C. stirred Morton flask equipped with a condenser, under $N_2$ atmosphere, charged with water (150 g), surfactant F-4 (2.9 g of a 21.3% aqueous solution), and initiator (azobis(cyanovaleric acid) 75%, 0.50 g, Aldrich). The resulting latex was stirred at 80° C. for an additional 75 minutes. The latex was cooled and filtered, yielding 497 g latex at 18.85% solids. Photon correlation spectroscopy showed an average particle size of 0.084 microns.

Example 2:

Stability of latex polymers with water-miscible solvents

Latex polymer P-1, prepared as P-1d in synthesis example A above at 23.4% solids, was subjected to the test of latex loadability described in the prior art, in which the latex must be stable toward coagulation or flocculation in the presence of approximately an equal volume of the water-miscible solvent necessary for the loading to occur. Several different water-miscible solvents were tested with latex P-1. In addition, several other latex polymers were subjected to the test using acetone as the water miscible solvent. In all cases, the solvent or a solvent/water mixture was added to 2 mL of the latex, which contained between 19–24% of polymer by weight, and the appearance was noted immediately after mixing.

| Latex (2 mL) | Solvent added | Amount added | Appearance |
|---|---|---|---|
| P-1 | Acetone | 0.10 mL | Some coagulated |
| P-1 | Acetone | 0.05 mL | Some coagulated |
| P-1 | 75/25 Acetone/water | 4.0 mL | Coagulated |
| P-1 | Acetone | 2.0 mL | Coagulated |
| P-1 | Tetrahydrofuran | 2.0 mL | Coagulated |
| P-1 | Dimethylformamide | 2.0 mL | Coagulated |
| P-1 | Acetonitrile | 2.0 mL | Coagulated |
| P-1 | Acetonitrile | 0.5 mL | Some coagulated |

-continued

| Latex (2 mL) | Solvent added | Amount added | Appearance |
|---|---|---|---|
| P-31 | Acetone | 2.0 mL | Coagulated |
| P-31 | 75/25 Acetone/water | 4.0 mL | Coagulated |
| P-9 | Acetone | 2.0 mL | Coagulated |
| P-16 | Acetone | 2.0 mL | Coagulated |
| P-16 | 75/25 Acetone/water | 4.0 mL | Some coagulated |
| P-19 | Acetone | 2.0 mL | Coagulated |
| P-19 | 75/25 Acetone/water | 4.0 mL | Stable |
| P-36 | Acetone | 2.0 mL | Coagulated |
| P-36 | 75/25 Acetone/water | 4.0 mL | Stable |

As can be seen from the table, most of the latex polymers which can be employed successfully in the dispersions of the invention fail the test of latex-loadability described in the prior art using water-miscible organic solvent. Most fail even a less harsh test wherein the water miscible solvent is diluted with water before being combined with the latex. Thus, the process of the invention allows the preparation of photographic dispersions using latex polymer compositions that cannot be loaded by other techniques described in the prior art.

Example 3

Preparation of dispersions

Dispersion 101 was prepared by combining coupler Y-3 (45.0 g) with dibutyl phthalate (S-1) (25.2 g), and heating to 141° C., yielding an oil solution. This was combined with 430 g of a solution containing 39.0 g gelatin, 4.0 g surfactant F-1, and 387 g of water, and the mixture was mixed briefly with a blade mixer to yield a coarse dispersion (particle size >>1 micron). 40.0 g of this dispersion was combined with 25.0 g water and was recycled for three turnovers at 68 MPa with a Microfluidizer model 110 homogenizer.

Dispersions 102–121 were prepared similarly to dispersion 101, replacing the 25.0 g of water added to the coarse dispersion with 25.0 g of a polymer latex, at the proper concentration to achieve the desired coupler:polymer ratio.

Dispersion 122 was prepared similarly to dispersion 101, combining coupler Y-3 (45.0 g) with dibutyl phthalate (S-1) (25.2 g), and heating to 141° C., yielding an oil solution. This was combined with 330 g of a solution containing 39.0 g gelatin, 4.0 g surfactant F-1 and 287 g of water, and the mixture was mixed briefly with a Silverson blade mixer to yield a coarse dispersion (particle size >>1 micron). 32.0 g of this dispersion was combined with 33.0 g water and emulsified as above with a Microfluidizer.

Dispersions 123–149 were prepared similarly to dispersion 122, replacing the 33.0 g of water added to the coarse dispersion with 33.0 g of a polymer latex, at the proper concentration to achieve the desired coupler:polymer ratio. Dispersions 150–157 were prepared similarly to dispersion 149, substituting the solvent indicated for S-1, in the same amount, (0.56 solvent relative to coupler Y-3). All of the dispersions were examined by photon correlation spectroscopy to determine an average particle size.

| Sample | Solvent | Latex | Latex Size, μm | Latex: Coupler Ratio | Dispersion Size, μm | Comment |
|---|---|---|---|---|---|---|
| 101 | S-1 | — | — | 0.00 | 0.266 | Comparison |
| 102 | S-1 | P-1 | 0.067 | 0.50 | 0.170 | Invention |
| 103 | S-1 | P-1 | 0.067 | 1.00 | 0.149 | Invention |
| 104 | S-1 | P-1 | 0.067 | 1.40 | 0.154 | Invention |
| 105 | S-1 | P-2 | 0.110 | 0.50 | 0.178 | Invention |
| 106 | S-1 | P-2 | 0.110 | 1.00 | 0.174 | Invention |
| 107 | S-1 | P-2 | 0.110 | 1.40 | 0.160 | Invention |
| 108 | S-1 | P-1 | 0.048 | 0.50 | 0.183 | Invention |
| 109 | S-1 | P-1 | 0.110 | 0.50 | 0.194 | Invention |
| 110 | S-1 | P-1 | 0.110 | 1.00 | 0.179 | Invention |
| 111 | S-1 | P-1 | 0.110 | 1.40 | 0.155 | Invention |
| 112 | S-1 | P-2 | 0.066 | 0.50 | 0.145 | Invention |
| 113 | S-1 | P-4 | 0.262 | 0.41 | 0.287 | Invention |
| 114 | S-1 | P-3 | 0.078 | 0.48 | 0.153 | Invention |
| 115 | S-1 | P-8 | 0.059 | 0.44 | 0.155 | Invention |
| 116 | S-1 | P-5 | 0.068 | 0.47 | 0.164 | Invention |
| 117 | S-1 | P-6 | 0.277 | 1.00 | 0.312 | Invention |
| 118 | S-1 | P-19 | 0.102 | 1.00 | 0.163 | Invention |
| 119 | S-1 | P-15 | 0.128 | 0.50 | 0.182 | Invention |
| 120 | S-1 | P-15 | 0.128 | 1.00 | 0.160 | Invention |
| 121 | S-1 | P-15 | 0.128 | 1.40 | 0.153 | Invention |
| 122 | S-1 | — | — | 0.00 | 0.256 | Comparison |
| 123 | S-1 | P-10 | 0.045 | 0.50 | 0.142 | Invention |
| 124 | S-1 | P-10 | 0.045 | 1.00 | 0.141 | Invention |
| 125 | S-1 | P-12 | 0.154 | 0.50 | 0.218 | Invention |
| 126 | S-1 | P-12 | 0.154 | 1.00 | 0.200 | Invention |
| 127 | S-1 | P-12 | 0.154 | 1.50 | 0.193 | Invention |
| 128 | S-1 | P-10 | 0.107 | 0.50 | 0.190 | Invention |
| 129 | S-1 | P-10 | 0.107 | 1.00 | 0.148 | Invention |
| 130 | S-1 | P-10 | 0.107 | 1.50 | 0.145 | Invention |
| 134 | S-1 | P-11 | 0.116 | 0.50 | 0.211 | Invention |
| 134 | S-1 | P-11 | 0.116 | 1.00 | 0.193 | Invention |
| 135 | S-1 | P-14 | 0.084 | 1.00 | 0.174 | Invention |
| 137 | S-1 | P-16 | 0.084 | 0.50 | 0.205 | Invention |
| 138 | S-1 | P-16 | 0.084 | 1.00 | 0.152 | Invention |
| 139 | S-1 | P-16 | 0.084 | 1.50 | 0.187 | Invention |
| 140 | S-1 | P-9 | 0.082 | 0.50 | 0.159 | Invention |
| 141 | S-1 | P-9 | 0.082 | 1.00 | 0.126 | Invention |
| 142 | S-1 | P-9 | 0.082 | 1.50 | 0.119 | Invention |
| 143 | S-1 | P-31 | 0.060 | 0.50 | 0.186 | Invention |
| 144 | S-1 | P-31 | 0.060 | 1.00 | 0.176 | Invention |
| 145 | S-1 | P-37 | 0.086 | 0.50 | 0.215 | Invention |
| 146 | S-1 | P-37 | 0.086 | 1.00 | 0.191 | Invention |
| 147 | S-1 | P-34 | — | 1.00 | 0.196 | Invention |
| 148 | S-1 | P-32 | — | 1.00 | — | Invention |
| 149 | S-1 | P-1 | 0.069 | 0.80 | 0.164 | Invention |
| 150 | S-9 | P-1 | 0.069 | 0.80 | 0.162 | Invention |
| 151 | S-4 | P-1 | 0.069 | 0.80 | 0.195 | Invention |
| 152 | S-7 | P-1 | 0.069 | 0.80 | 0.144 | Invention |
| 153 | S-10 | P-1 | 0.069 | 0.80 | 0.156 | Invention |
| 154 | S-11 | P-1 | 0.069 | 0.80 | 0.153 | Invention |
| 155 | S-2 | P-1 | 0.069 | 0.80 | 0.199 | Invention |
| 156 | S-12 | P-1 | 0.069 | 0.80 | 0.216 | Invention |
| 157 | S-13 | P-1 | 0.069 | 0.80 | 0.146 | Invention |

As can be seen from this table, the presence of the latex polymer in the dispersion had a large impact on the final dispersion size. In general, small diameter latex polymers produce small diameter loaded latex dispersions, and increasing polymer level also tends to give smaller dispersion diameters.

Example 4

Coating sample 201, a blue-sensitive photographic element containing dispersion 101 in the emulsion layer was prepared by coating the following layers.

| LAYER | COMPONENT | AMOUNT |
|---|---|---|
| 2 | F-1 | 0.054 g/m$^2$ |
| | F-2 | 0.004 g/m$^2$ |
| | Dye-1 | 0.018 g/m$^2$ |
| | Gelatin | 1.076 g/m$^2$ |
| 1 | AG-1 Blue sensitive Ag | 0.247 g Ag/m$^2$ |
| | Y-3 from dispersion 101 | 0.538 g/m$^2$ |
| | ST-15 | 0.009 g/m$^2$ |
| | F-1 | 0.054 g/m$^2$ |
| | Gelatin | 1.539 g/m$^2$ |
| Support | Polyethylene laminated paper with $TiO_2$/ZnO in the polyethylene laminated in the first layer side, precoated with 3.23 g/m$^2$ gelatin. | |

In the final layer bis(vinylsulfonylmethyl) ether (0.105 g/m$^2$) was added as hardener.

AG-1 Blue Emulsion: A high chloride silver halide emulsion was precipitated by equimolar addition of silver nitrate and sodium chloride solutions into a well-stirred reactor containing gelatin peptizer and thioether ripener. $Cs_2OS(NO)Cl_5$ was added during the silver halide grain formation for most of the precipitation, followed by shelling without dopant. The resultant emulsion contained cubic shaped grains of 0.74 μm in edgelength size. This emulsion was optimally sensitized by the addition of water insoluble gold compound and heat ramped up to 60 ° C. during which time blue sensitizing dye BSD-1, 1-(3-acetamidophenyl)-5-mercaptotetrazole and potassium bromide were added. In addition, iridium dopant was added during the sensitization process.

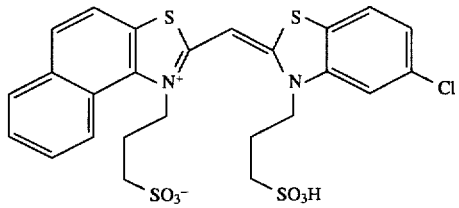

BSD-1

Coating examples 202–257 were prepared similarly to example 201, using dispersions 102–157 described above.

Coating example 258 was prepared using dispersion 101 containing no latex polymer, and adding latex polymer P-1 (0.110 μm, 1.0 ratio by weight to coupler Y-3) to the coating solution. This coating therefore contains the same components as coating sample 210, but the latex was not included in a high-shear mixing process in the preparation of the dispersion.

The coatings were exposed for 0.10 s at a color temperature of 3000K through a Wratten W98 filter and a 0–3 density 21-step tablet, and were processed through the Kodak RA-4 process, described in the British Journal of Photography Annual of 1988, Pp 198–199, comprising the following processing solutions, times and temperatures.

| Kodak RA-4 process | | |
|---|---|---|
| Developer | 0'45" | 35° C. |
| Bleach-Fix | 0'45" | 35° C. |
| Wash | 1'30" | 33–34° C. |

The following table shows data relating to the light stability, hue, and heat stability of the coatings.

To obtain light stability information, each coating was covered with a UV filter layer coated on cellulose acetate support, containing 0.65 g/m$^2$ of a 15:85 by weight mixture of UV absorbers UV-1 and UV-2, 0.22 g/m$^2$ of solvent S-8, 0.074 g/m$^2$ of ST-4, and 1.26 g/m$^2$ of gelatin. The coatings were subjected to 14 day 50 klx irradiation with a daylight source. The light stability of the coating was measured as blue reflection density loss from density 1.0 and 0.5.

The hue of each coating was measured at the exposure step nearest a blue optical density of 1.0. The position of the bathochromic edge of the absorption curve is indicated in the next column, which gives a normalized density at 500 nm, relative to a density of 1.0 at $\lambda_{max}$ for the dye.

The next column shows the blue density loss from 1.0 density for each coating after high temperature treatment at 85° C. and 40% relative humidity for 28 days.

| Sample | Polymer/ Polymer:Coupler Ratio | Density Loss 14 d 50klx from 1.0 | Density Loss 14 d 50klx from 0.5 | Hue 1.0 D @ 500/ D @ $\lambda_{max}$ | Density Loss 28 d 85° C. 40RH from 1.0 | Comment |
|---|---|---|---|---|---|---|
| 201 | none | 0.51 | 0.34 | 0.553 | 0.19 | Comparison |
| 202 | P-1/0.5 | 0.17 | 0.13 | 0.520 | 0.12 | Invention |
| 203 | P-1/1.0 | 0.10 | 0.07 | 0.497 | 0.08 | Invention |
| 204 | P-1/1.4 | 0.08 | 0.07 | 0.488 | 0.00 | Invention |
| 205 | P-2/0.5 | 0.22 | 0.15 | 0.535 | 0.16 | Invention |
| 206 | P-2/1.0 | 0.10 | 0.08 | 0.517 | 0.10 | Invention |
| 207 | P-2/1.4 | 0.09 | 0.07 | 0.481 | 0.04 | Invention |
| 208 | P-1/0.5 | 0.17 | 0.12 | 0.516 | 0.13 | Invention |
| 209 | P-1/0.5 | 0.28 | 0.18 | 0.529 | 0.12 | Invention |
| 210 | P-1/1.0 | 0.16 | 0.12 | 0.496 | 0.09 | Invention |
| 211 | P-1/1.4 | 0.12 | 0.08 | 0.481 | 0.04 | Invention |
| 212 | P-2/0.5 | 0.17 | 0.12 | 0.530 | 0.13 | Invention |
| 213 | P-4/0.41 | 0.33 | 0.26 | 0.536 | 0.18 | Invention |
| 214 | P-3/0.48 | 0.17 | 0.13 | 0.523 | 0.14 | Invention |
| 215 | P-8/0.44 | 0.25 | 0.19 | 0.521 | 0.18 | Invention |
| 216 | P-5/0.47 | 0.21 | 0.16 | 0.519 | 0.14 | Invention |
| 217 | P-6/1.0 | 0.28 | 0.21 | 0.510 | 0.15 | Invention |
| 218 | P-19/1.0 | 0.17 | 0.14 | 0.523 | 0.13 | Invention |
| 219 | P-15/0.5 | 0.32 | 0.23 | 0.536 | 0.22 | Invention |
| 220 | P-15/1.0 | 0.24 | 0.17 | 0.526 | 0.23 | Invention |
| 221 | P-15/1.4 | 0.18 | 0.14 | 0.519 | 0.24 | Invention |
| 222 | none | 0.50 | 0.35 | 0.556 | 0.21 | Comparison |
| 223 | P-10/0.5 | 0.17 | 0.13 | 0.532 | 0.12 | Invention |
| 224 | P-10/1.0 | 0.11 | 0.07 | 0.503 | 0.06 | Invention |
| 225 | P-12/0.5 | 0.31 | 0.21 | 0.534 | 0.18 | Invention |
| 226 | P-12/1.0 | 0.25 | 0.17 | 0.520 | 0.16 | Invention |
| 227 | P-12/1.5 | 0.19 | 0.14 | 0.508 | 0.16 | Invention |
| 228 | P-10/0.5 | 0.34 | 0.21 | 0.533 | 0.15 | Invention |
| 229 | P-10/1.0 | 0.20 | 0.14 | 0.505 | 0.10 | Invention |
| 230 | P-10/1.5 | 0.14 | 0.08 | 0.479 | 0.01 | Invention |
| 234 | P-11/0.5 | 0.27 | 0.20 | 0.537 | 0.16 | Invention |
| 234 | P-11/1.0 | 0.14 | 0.11 | 0.510 | 0.12 | Invention |

-continued

| Sample | Polymer/ Polymer:Coupler Ratio | Density Loss 14 d 50klx from 1.0 | from 0.5 | Hue 1.0 D @ 500/ D @ $\lambda_{max}$ | Density Loss 28 d 85° C. 40RH from 1.0 | Comment |
|---|---|---|---|---|---|---|
| 235 | P-14/1.0 | 0.22 | 0.15 | 0.527 | 0.17 | Invention |
| 237 | P-16/0.5 | 0.15 | 0.10 | 0.545 | 0.19 | Invention |
| 238 | P-16/1.0 | 0.27 | 0.20 | 0.531 | 0.18 | Invention |
| 239 | P-16/1.5 | 0.22 | 0.15 | 0.524 | 0.15 | Invention |
| 240 | P-9/0.5 | 0.25 | 0.17 | 0.538 | 0.15 | Invention |
| 241 | P-9/1.0 | 0.15 | 0.10 | 0.513 | 0.11 | Invention |
| 242 | P-9/1.5 | 0.11 | 0.07 | 0.500 | 0.09 | Invention |
| 243 | P-31/0.5 | 0.31 | 0.22 | 0.557 | 0.13 | Invention |
| 244 | P-31/1.0 | 0.19 | 0.15 | 0.537 | 0.09 | Invention |
| 245 | P-37/0.5 | 0.40 | 0.32 | 0.550 | 0.19 | Invention |
| 246 | P-37/1.0 | 0.28 | 0.23 | 0.546 | 0.17 | Invention |
| 247 | P-34/1.0 | 0.34 | 0.27 | 0.567 | stain | Invention |
| 248 | P-32/1.0 | 0.40 | 0.30 | 0.551 | 0.10 | Invention |
| 249 | P-1/0.8 | 0.18 | 0.12 | 0.473 | 0.07 | Invention |
| 250 | P-1/0.8 | 0.18 | 0.12 | 0.452 | 0.08 | Invention |
| 251 | P-1/0.8 | 0.15 | 0.10 | 0.439 | 0.18 | Invention |
| 252 | P-1/0.8 | 0.13 | 0.09 | 0.462 | 0.08 | Invention |
| 253 | P-1/0.8 | 0.19 | 0.13 | 0.479 | 0.02 | Invention |
| 254 | P-1/0.8 | 0.17 | 0.11 | 0.464 | 0.16 | Invention |
| 255 | P-1/0.8 | 0.17 | 0.11 | 0.459 | 0.12 | Invention |
| 256 | P-1/0.8 | 0.16 | 0.11 | 0.438 | 0.21 | Invention |
| 257 | P-1/0.8 | 0.15 | 0.11 | 0.523 | 0.14 | Invention |
| 258 | P-1/1.0 | 0.30 | 0.21 | 0.522 | 0.06 | Comparison |

As can be seen from the table, most of the latex-containing dispersions of this invention show improved dye light stability and improved dye thermal stability relative to the comparison without latex. Most of the latex-containing dispersions also give a purer yellow dye hue with a sharper-cutting bathochromic edge of the absorption curve, as shown by lower normalized density at 500 nm, relative to the examples without latex. Comparison example 258 in which the latex polymer was added to the coating solution has substantially less light stability and less favorable dye hue than example 210, which contains the same components, but with the latex included in the high-shear step of the dispersion preparation.

Example 5

Coating sample 301 was prepared by coating the following layers on a paper support.

| LAYER | COMPONENT | AMOUNT |
|---|---|---|
| 7 | ST-4 | 0.022 g/m$^2$ |
| | S-1 | 0.065 g/m$^2$ |
| | F-1 | 0.009 g/m$^2$ |
| | F-2 | 0.004 g/m$^2$ |
| | Dye-1 | 0.018 g/m$^2$ |
| | Dye-2 | 0.009 g/m$^2$ |
| | Dye-3 | 0.007 g/m$^2$ |
| | Gelatin | 1.076 g/m$^2$ |
| 6 | UV-1 | 0.049 g/m$^2$ |
| | UV-2 | 0.279 g/m$^2$ |
| | ST-4 | 0.080 g/m$^2$ |
| | S-8 | 0.109 g/m$^2$ |
| | S-1 | 0.129 g/m$^2$ |
| | Gelatin | 0.630 g/m$^2$ |
| 5 | AG-3 Red sensitive Ag | 0.218 g Ag/m$^2$ |
| | C-3 | 0.423 g/m$^2$ |
| | S-1 | 0.232 g/m$^2$ |
| | S-14 | 0.035 g/m$^2$ |
| | ST-4 | 0.004 g/m$^2$ |
| | Gelatin | 1.087 g/m$^2$ |
| 4 | UV-1 | 0.049 g/m$^2$ |
| | UV-2 | 0.279 g/m$^2$ |

-continued

| LAYER | COMPONENT | AMOUNT |
|---|---|---|
| | ST-4 | 0.080 g/m$^2$ |
| | S-8 | 0.109 g/m$^2$ |
| | S-1 | 0.129 g/m$^2$ |
| | Gelatin | 0.630 g/m$^2$ |
| 3 | AG-2 Green sensitive Ag | 0.263 g Ag/m$^2$ |
| | M-1 | 0.389 g/m$^2$ |
| | S-1 | 0.195 g/m$^2$ |
| | S-14 | 0.058 g/m$^2$ |
| | ST-2 | 0.166 g/m$^2$ |
| | ST-4 | 0.039 g/m$^2$ |
| | Gelatin | 1.270 g/m$^2$ |
| 2 | ST-4 | 0.094 g/m$^2$ |
| | S-1 | 0.282 g/m$^2$ |
| | ST-14 | 0.065 g/m$^2$ |
| | F-1 | 0.002 g/m$^2$ |
| | Gelatin | 0.753 g/m$^2$ |
| 1 | AG-1 Blue sensitive Ag | 0.243 g Ag/m$^2$ |
| | Y-3 | 0.538 g/m$^2$ |
| | ST-6 | 0.237 g/m$^2$ |
| | S-1 | 0.301 g/m$^2$ |
| | ST-15 | 0.009 g/m$^2$ |
| | glycerol | 0.162 g/m$^2$ |
| | Gelatin | 1.042 g/m$^2$ |
| Support | Polyethylene laminated paper with $TiO_2$/ZnO in the polyethylene laminated in the first layer side. | |

Bis(vinylsulfonylmethyl) ether (1.97% to total gelatin weight) was added as hardener.

Silver chloride emulsions were chemically and spectrally sensitized as described below.

AG-3 Red Emulsion: A high chloride silver halide emulsion was precipitated by equimolar addition of silver nitrate and sodium chloride solutions into a well-stirred reactor containing gelatin peptizer and thioether ripener. The resultant emulsion contained cubic shaped grains of 0.40 μm in edgelength size. This emulsion was optimally sensitized by the addition of water insoluble gold compound followed by a heat ramp, and further additions of 1-(3-acetamidophenyl)-5-mercaptotetrazole, potassium bromide and red sensitizing dye RSD-1. In addition, iridium and ruthenium dopants were added during the sensitization process.

AG-2 Green Emulsion: A high chloride silver halide emulsion was precipitated by equimolar addition of silver nitrate and sodium chloride solutions into a well-stirred reactor containing gelatin peptizer and thioether ripener. $Cs_2Os(NO)Cl_5$ dopant was added during the silver halide grain formation for most of the precipitation, followed by a shelling without dopant. Iridium dopant was added during the late stage of grain formation. The resultant emulsion contained cubic shaped grains of 0.30 μm in edgelength size. This emulsion was optimally sensitized with green sensitizing dye GSD-1, water insoluble gold compound, heat digestion followed by the addition of 1-(3-acetamidophenyl)-5-mercaptotetrazole and potassium bromide.

RSD-1

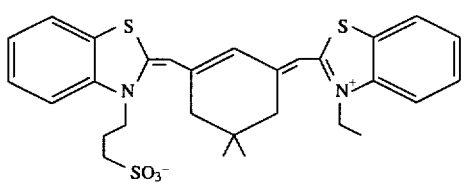

GSD-1

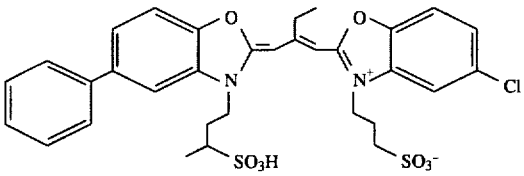

Absorber dyes used were the following:

Dye-1

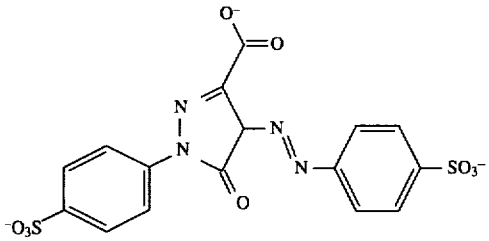

Dye-2

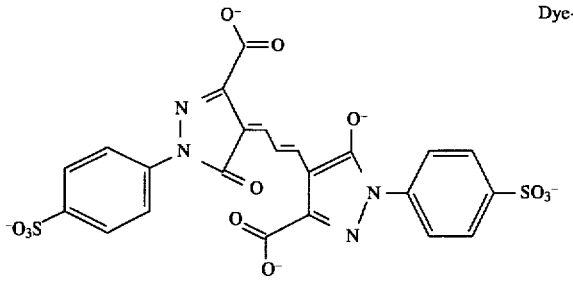

Dye-3

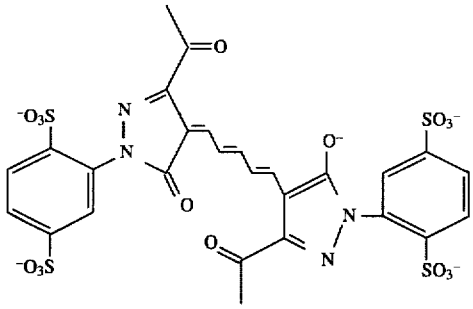

Coating sample 302 was prepared similarly to 301, omitting stabilizer ST-6 in the dispersion of coupler Y-3 used in the blue-sensitive emulsion layer 1.

Coating samples 303–311 were prepared similarly to sample 302, but introducing coupler Y-3 in layer 1 as a loaded latex dispersion of the invention, prepared by methods similar to those described in example 3. Stabilizer ST-6 was omitted from the dispersions used for 303–311. The changes in the coating composition (coupler laydown, latex polymer, latex particle size and polymer laydown) are shown in the table below.

| Sample | Y-3 g/m² | Latex | Latex size, μm | Latex g/m² | S-1 g/m² | Comment |
|---|---|---|---|---|---|---|
| 301 | 0.538 | none | — | — | 0.301 | Comparison |
| 302 | 0.531 | none | — | — | 0.301 | Comparison |
| 303 | 0.538 | P-1 | 0.072 | 0.215 | 0.301 | Invention |
| 304 | 0.538 | P-1 | 0.072 | 0.430 | 0.301 | Invention |
| 305 | 0.538 | P-1 | 0.072 | 0.430 | 0.463 | Invention |
| 306 | 0.538 | P-1 | 0.094 | 0.646 | 0.301 | Invention |
| 307 | 0.619 | P-1 | 0.094 | 0.742 | 0.301 | Invention |
| 308 | 0.538 | P-10 | 0.070 | 0.215 | 0.301 | Invention |
| 309 | 0.538 | P-10 | 0.070 | 0.430 | 0.301 | Invention |
| 310 | 0.538 | P-31 | 0.064 | 0.215 | 0.301 | Invention |
| 311 | 0.538 | P-31 | 0.064 | 0.430 | 0.301 | Invention |

Dried samples of the Y-3 coupler dispersions used to prepare coating samples 301–311 were examined by optical microscopy under crossed polarizers, showing that no significant crystals were in the dispersions. The dispersion samples were maintained at 40° C. for 24 hours, and dried samples were again examined by optical microscopy. The comparison dispersions used to prepare samples 301–302 showed significant crystal formation. None of the dispersions of the invention showed significant crystal formation.

Samples 301–311 were exposed and processed as in example 4 and the images were subjected to 14 day 50 klx irradiation with a daylight source. The light stability of the coating was measured as blue reflection density loss from patches of density 1.0 and 0.5. The coatings of loaded latex dispersions of the invention had much less dye fade than the comparison sample 302 with no polymer, and many had better performance than comparison sample 301 containing the small-molecule stabilizer ST-6.

| Sample | Loss from density 1.0 | Loss from density 0.5 | Comment |
|---|---|---|---|
| 301 | −.57 | −.34 | Comparison |
| 302 | −.89 | −.39 | Comparison |
| 303 | −.51 | −.32 | Invention |
| 304 | −.29 | −.22 | Invention |
| 305 | −.28 | −.23 | Invention |
| 306 | −.25 | −.17 | Invention |
| 307 | −.23 | −.18 | Invention |
| 308 | −.47 | −.31 | Invention |
| 309 | −.30 | −.23 | Invention |
| 310 | −.65 | −.35 | Invention |
| 311 | −.43 | −.29 | Invention |

The coating samples 301–311 were tested for wet scratch resistance and wet adhesion to the support after 14 days aging at ambient conditions. The samples were submerged in Kodak RA-4 developer solution at 35° C. for 45 seconds, and a perpendicular stylus with a spherical sapphire tip was drawn over the sample surface with a constantly increasing mass load. The load required for the stylus penetrate completely through the coating was measured for styli of 0.20 mm and 0.38 mm diameter. Any adhesive failure of the coating to the support adjacent to the scribe line was noted. The results are shown below in the table.

| Sample | grams load for 0.20 mm stylus | grams load for 0.38 mm stylus | Adhesive failure | Comment |
|---|---|---|---|---|
| 301 | 16.5 | 46.5 | none | Comparison |
| 302 | 19.0 | 51.5 | moderate | Comparison |
| 303 | 31.0 | 103.5 | moderate | Invention |
| 304 | 32.5 | 110.5 | none | Invention |
| 305 | 29.0 | 99.0 | none | Invention |
| 306 | 31.0 | 99.0 | none | Invention |
| 307 | 31.0 | 99.5 | none | Invention |
| 308 | 31.5 | 100.0 | none | Invention |
| 309 | 32.0 | 103.5 | none | Invention |
| 310 | 25.5 | 83.0 | none | Invention |
| 311 | 25.0 | 76.0 | none | Invention |

As can be seen from the table, the coatings containing dispersions of the invention have excellent wet scratch resistance and excellent adhesion to the support.

Example 6

Coating sample 401 was prepared by coating the following layers on a paper support.

| LAYER | COMPONENT | AMOUNT |
|---|---|---|
| 7 | ST-4 | 0.021 g/m$^2$ |
| | S-1 | 0.064 g/m$^2$ |
| | F-1 | 0.009 g/m$^2$ |
| | F-2 | 0.004 g/m$^2$ |
| | Dye-1 | 0.021 g/m$^2$ |
| | Dye-2 | 0.009 g/m$^2$ |
| | Dye-3 | 0.019 g/m$^2$ |
| | Gelatin | 1.076 g/m$^2$ |
| 6 | UV-1 | 0.048 g/m$^2$ |
| | UV-2 | 0.274 g/m$^2$ |
| | ST-4 | 0.037 g/m$^2$ |
| | S-8 | 0.108 g/m$^2$ |
| | Gelatin | 0.716 g/m$^2$ |
| 5 | AG-3 Red sensitive Ag | 0.212 g Ag/m$^2$ |
| | C-3 | 0.423 g/m$^2$ |
| | S-1 | 0.232 g/m$^2$ |
| | S-14 | 0.035 g/m$^2$ |
| | ST-4 | 0.004 g/m$^2$ |
| | Gelatin | 1.087 g/m$^2$ |
| 4 | UV-1 | 0.048 g/m$^2$ |
| | UV-2 | 0.274 g/m$^2$ |
| | ST-4 | 0.037 g/m$^2$ |
| | S-8 | 0.108 g/m$^2$ |
| | Gelatin | 0.716 g/m$^2$ |
| 3 | AG-2 Green sensitive Ag | 0.257 g Ag/m$^2$ |
| | M-1 | 0.389 g/m$^2$ |
| | S-1 | 0.195 g/m$^2$ |
| | S-14 | 0.058 g/m$^2$ |
| | ST-2 | 0.166 g/m$^2$ |
| | ST-4 | 0.039 g/m$^2$ |
| | Gelatin | 1.270 g/m$^2$ |
| 2 | ST-4 | 0.094 g/m$^2$ |
| | S-1 | 0.282 g/m$^2$ |
| | ST-14 | 0.065 g/m$^2$ |
| | F-1 | 0.002 g/m$^2$ |
| | Gelatin | 0.753 g/m$^2$ |
| 1 | AG-1 Blue sensitive Ag | 0.267 g Ag/m$^2$ |
| | Y-1 | 1.076 g/m$^2$ |
| | S-1 | 0.269 g/m$^2$ |
| | S-14 | 0.269 g/m$^2$ |
| | ST-15 | 0.009 g/m$^2$ |
| | Gelatin | 1.53 g/m$^2$ |
| Support | Polyethylene laminated paper with $TiO_2$/ZnO in the polyethylene laminated in the first layer side. | |

Bis(vinylsulfonylmethyl) ether (1.95% to total gelatin weight) was added as hardener.

Similarly, coating 402 was prepared with the following structure, with coupler M-2 in the green-sensitive layer 3, and incorporating in the blue sensitive layer 1 a dispersion according to the invention of yellow coupler Y-3, polymer P-17, stabilizer ST-6, and solvent S-1:

| LAYER | COMPONENT | AMOUNT |
|---|---|---|
| 7 | ST-4 | 0.021 g/m$^2$ |
| | S-1 | 0.064 g/m$^2$ |
| | F-1 | 0.009 g/m$^2$ |
| | F-2 | 0.004 g/m$^2$ |
| | Dye-1 | 0.021 g/m$^2$ |
| | Dye-2 | 0.009 g/m$^2$ |
| | Dye-3 | 0.019 g/m$^2$ |
| | Gelatin | 1.076 g/m$^2$ |
| 6 | UV-1 | 0.073 g/m$^2$ |
| | UV-2 | 0.276 g/m$^2$ |
| | ST-4 | 0.050 g/m$^2$ |
| | S-8 | 0.109 g/m$^2$ |
| | S-1 | 0.129 g/m$^2$ |
| | Gelatin | 0.624 g/m$^2$ |
| 5 | AG-3 Red sensitive Ag | 0.212 g Ag/m$^2$ |
| | C-3 | 0.423 g/m$^2$ |
| | UV-2 | 0.272 g/m$^2$ |
| | S-1 | 0.415 g/m$^2$ |
| | S-14 | 0.035 g/m$^2$ |
| | ST-4 | 0.004 g/m$^2$ |
| | Gelatin | 1.388 g/m$^2$ |
| 4 | UV-1 | 0.073 g/m$^2$ |
| | UV-2 | 0.276 g/m$^2$ |
| | ST-4 | 0.050 g/m$^2$ |
| | S-8 | 0.109 g/m$^2$ |
| | S-1 | 0.129 g/m$^2$ |
| | Gelatin | 0.624 g/m$^2$ |
| 3 | AG-2 Green sensitive Ag | 0.174 g Ag/m$^2$ |
| | M-2 | 0.344 g/m$^2$ |
| | S-4 | 0.564 g/m$^2$ |
| | ST-3 | 0.107 g/m$^2$ |
| | ST-16 | 0.180 g/m$^2$ |
| | ST-5 | 0.180 g/m$^2$ |
| | Gelatin | 1.270 g/m$^2$ |
| 2 | ST-4 | 0.156 g/m$^2$ |
| | S-1 | 0.468 g/m$^2$ |
| | ST-14 | 0.065 g/m$^2$ |
| | F-1 | 0.002 g/m$^2$ |
| | Gelatin | 0.753 g/m$^2$ |
| 1 | AG-1 Blue sensitive Ag | 0.246 g Ag/m$^2$ |
| | Y-3 | 0.538 g/m$^2$ |
| | P-17 | 0.807 g/m$^2$ |
| | ST-6 | 0.225 g/m$^2$ |
| | S-1 | 0.287 g/m$^2$ |
| | ST-15 | 0.009 g/m$^2$ |
| | Gelatin | 1.280 g/m$^2$ |
| Support | Polyethylene laminated paper with $TiO_2$/ZnO in the polyethylene laminated in the first layer side. | |

Coating 403 was prepared with the following structure, with coupler C-13 in the red-sensitive layer 5, coupler M-11 in the green-sensitive layer 3, and incorporating in the blue sensitive layer 1, a dispersion of the invention of yellow coupler Y-3, polymer P-15, stabilizer ST-6, and solvent S-1:

| LAYER | COMPONENT | AMOUNT |
|---|---|---|
| 7 | ST-4 | 0.021 g/m$^2$ |
| | S-1 | 0.064 g/m$^2$ |
| | F-1 | 0.009 g/m$^2$ |
| | F-2 | 0.004 g/m$^2$ |
| | Dye-1 | 0.021 g/m$^2$ |
| | Dye-2 | 0.009 g/m$^2$ |
| | Dye-3 | 0.019 g/m$^2$ |
| | Gelatin | 1.076 g/m$^2$ |

-continued

| LAYER | COMPONENT | AMOUNT |
|---|---|---|
| 6 | UV-1 | 0.073 g/m² |
| | UV-2 | 0.276 g/m² |
| | ST-4 | 0.129 g/m² |
| | S-8 | 0.109 g/m² |
| | S-1 | 0.387 g/m² |
| | Gelatin | 1.076 g/m² |
| 5 | AG-3 Red sensitive Ag | 0.207 g Ag/m² |
| | C-13 | 0.423 g/m² |
| | UV-2 | 0.272 g/m² |
| | S-2 | 0.415 g/m² |
| | S-14 | 0.035 g/m² |
| | ST-4 | 0.004 g/m² |
| | Gelatin | 1.388 g/m² |
| 4 | UV-1 | 0.073 g/m² |
| | UV-2 | 0.276 g/m² |
| | ST-4 | 0.129 g/m² |
| | S-8 | 0.109 g/m² |
| | S-1 | 0.387 g/m² |
| | Gelatin | 1.076 g/m² |
| 3 | AG-2 Green sensitive Ag | 0.166 g Ag/m² |
| | M-11 | 0.323 g/m² |
| | S-1 | 0.485 g/m² |
| | ST-1 | 0.107 g/m² |
| | Gelatin | 1.270 g/m² |
| 2 | ST-4 | 0.189 g/m² |
| | S-1 | 0.567 g/m² |
| | ST-14 | 0.065 g/m² |
| | F-1 | 0.002 g/m² |
| | Gelatin | 1.130 g/m² |
| 1 | AG-1 Blue sensitive Ag | 0.261 g Ag/m² |
| | Y-3 | 0.538 g/m² |
| | P-15 | 1.076 g/m² |
| | ST-6 | 0.225 g/m² |
| | S-1 | 0.287 g/m² |
| | ST-15 | 0.009 g/m² |
| | Gelatin | 1.54 g/m² |
| Support | Polyethylene laminated paper with $TiO_2$/ZnO in the polyethylene laminated in the first layer side. | |

Coating 404 was prepared similarly to coating 403, replacing polymer P-15 in the yellow coupler dispersion used in layer 1 with 0.430 g/m² polymer P-1, and increasing the silver level to 0.294 g Ag/m² in the blue layer.

Coating 405 was prepared similarly to coating 404, using a paper support containing impregnated poly(vinyl alcohol) in the fiber base, as described in WO 93/04399.

The coated samples 401–405 were given red, green and blue stepped exposures, and were processed through the Kodak RA-4 process as described in example 4. The resulting images were subjected to 28 day 50 klx irradiation with a daylight source. The light stability of the coatings was measured as the loss in red, green, and blue reflection density from a patch of initial density 1.0.

| Sample | Yellow Density Loss from 1.0 | Magenta Density Loss from 1.0 | Cyan Density Loss from 1.0 | Comment |
|---|---|---|---|---|
| 401 | −.67 | −.77 | −.26 | Comparison |
| 402 | −.31 | −.43 | −.21 | Invention |
| 403 | −.24 | −.14 | −.13 | Invention |
| 404 | −.26 | −.15 | −.13 | Invention |
| 405 | −.15 | −.09 | −.12 | Invention |

As can be seen from the table, the comparison coating 401 shows both greater density loss on exposure to high intensity light, and a less neutral or uniform density loss among the three color records. The improved performance of coatings 402–405 demonstrates that advantageous combinations of the dispersions of the invention with other couplers and stabilizers are possible, to give photographic elements with improved overall image permanence.

Coating samples 406 and 407 are prepared similarly to coatings 402 and 403, but with 1/10 of the coated silver levels in each of the emulsion layers. The coatings are processed using an amplified developer process such as described in U.S. Pat. Nos. 4,791,048; 4,880,726; and 4,954,425; EP 90/013,061; 91/016,666; 91/017,479; 92/001,972; 92/001,972; 92/005,471; 92/007,299; 93/001,524; 03/011,460; and German published patent application OLS 4,211,460. Coatings that are prepared and processed in this manner comprising dispersions of the invention show advantages in image permanence similar to those described for samples 402 and 403.

Example 7

Gelatin-free dispersion 501 was prepared by combining water (99 g) surfactant F-2 (1.43 g of a 24% solution) and UV-7 (3.44 g). The mixture was first mixed for 120 s with a blade mixer to obtain a coarse-particle dispersion, and was then homogenized by recycling for 4 turnovers at 68 Mpa with a Microfluidizer at 70° C.

Gelatin-free dispersion 502 was prepared by combining UV-absorber latex P-40 (100 g latex 23.4% solids, prepared using 0.57 g of surfactant F-1, $T_g$=82° C. measured by DSC) and UV-7 (0.81 g), followed by mixing with a blade mixer and Microfluidizer at 70° C. as for dispersion 501. Similarly dispersion 503–509 were prepared as shown in the table below, varying the amount of UV-7 added to the dispersion.

The comparison dispersion 501 containing no polymer was unstable after 24 hours at 24° C., showing particle growth and large-scale phase-separation of the hydrophobic compound UV-7. By comparison, dispersions 502–509 of the invention were stable for at least 14 days at 24° C. Measurements of the glass transition temperature $T_g$ of each dispersion showed a steady change in $T_g$ with changing P-40: UV-7 ratio, consistent with what should be expected for a loaded latex composition.

| Sample | P-40:UV-7 Weight Ratio | Tg of Dispersion | Stability of Dispersion | Comment |
|---|---|---|---|---|
| 501 | 0.0:1.000 | −32° C. | unstable | comparison |
| 502 | 1.0:0.032 | 73° C. | stable | invention |
| 503 | 1.0:0.066 | 63° C. | stable | invention |
| 504 | 1.0:0.099 | 56° C. | stable | invention |
| 505 | 1.0:0.131 | 52° C. | stable | invention |
| 506 | 1.0:0.161 | 46° C. | stable | invention |
| 507 | 1.0:0.165 | 44° C. | stable | invention |
| 508 | 1.0:0.198 | 39° C. | stable | invention |
| 509 | 1.0:0.232 | 34° C. | stable | invention |

Example 8

Conventional dispersion 601 was prepared by preparing an aqueous solution of water (112.8 g) surfactant F-1 (8.0 g of a 10% solution) and gelatin (12.0 g) at 80° C. To this was added an oil solution of stabilizer ST-4 (3.0 g) and solvent S-1 (2.0 g), at 100° C. The mixture was first mixed with a blade mixer to obtain a coarse-particle dispersion, and was then homogenized by 2 passes at 68 MPa with a Microfluidizer at 80° C.

Gelatin-free dispersion 602 was prepared similarly to dispersion 601, omitting the 12.0 g of gelatin and adding 12.0 g of additional water to the aqueous solution.

Gelatin-free, latex-containing dispersion 603 was prepared similarly to dispersion 602, adding 26.4 g of UV-absorber polymer P-40 as a latex to the aqueous solution, and omitting an equal volume of water.

The comparison dispersions 601 and 602 and the dispersion of the invention 603 were examined by optical microscopy at 980× magnification and at 200× magnification with crossed polarizers to detect crystal formation. Samples of each dispersion were also dried on a glass slide and examined for further crystal formation. Photon correlation spectroscopy was also used to measure the particle size of each dispersion.

| Sample | Appearance at 980x | Crossed Polarizer at 200x | Dried Sample | Dispersion Size, μm | Comment |
|---|---|---|---|---|---|
| 601 | coarse particles | no crystals | no crystals | 0.384 | comparison |
| 602 | very coarse particles | some crystals | many crystals | 1.670 | comparison |
| 603 | very fine particles | no crystals | no crystals | 0.097 | invention |

As can be seen from the table, latex-containing dispersion 603 of the invention had very small particles with no tendency for formation of crystals of ST-4. This dispersion is stable toward coagulation or crystallization at room temperature for at least 7 days. Dispersion 602 with no polymer had very large particles severe crystal formation, and the dispersion was unstable at room temperature. Conventional gelatin dispersion 601 with no latex had no significant crystal formation, but had much larger particle size than dispersion 603 of the invention. Gelatin-free dispersions in accordance with this embodiment of the invention are also generally more resistant to microbial growth, and may be stored as stable liquids at room temperature for extended periods of time.

Example 9

Dispersion 701 was prepared by combining coupler C-13 (42.66 g), dibutyl phthalate ( S-1) (23.46 g), solvent S-14 (3.50 g) and stabilizer ST-4 (0.35 g), heating to 141° C., yielding an oil solution. This was combined with 380 g of a solution containing 42.66 g gelatin, 3.06 g surfactant F-1, and 334.28 g of water, and the mixture was mixed briefly with a blade mixer to yield a coarse dispersion (particle size >>1 micron). 30.0 g of this dispersion was combined with 30.0 g water and was recycled for two turnovers at 68 MPa with a Microfluidizer model 110 homogenizer.

Dispersions 702–705 were prepared similarly to dispersion 701, replacing the 30.0 g of water added to the coarse dispersion with 30.0 g of a polymer latex, at the proper concentration to achieve the desired coupler:polymer ratio.

Dispersion 706 was prepared similarly to dispersion 701, using coupler C-3 instead of C-13. Dispersions 707–709 were prepared similarly to dispersion 706, replacing the 30.0 g of water added to the coarse dispersion with 30.0 g of a polymer latex, at the proper concentration to achieve the desired coupler:polymer ratio.

Coating samples 801, a red-sensitive photographic element containing dispersion 701 and an additional dispersion of ST-4 dissolved in S-1 in the emulsion layer, was prepared by coating the following layers.

| LAYER | COMPONENT | AMOUNT |
|---|---|---|
| 2 | F-1 | 0.054 g/m$^2$ |
| | F-2 | 0.004 g/m$^2$ |
| | Gelatin | 1.076 g/m$^2$ |

-continued

| LAYER | COMPONENT | AMOUNT |
|---|---|---|
| 1 | AG-3 Red sensitive Ag | 0.198 g Ag/m$^2$ |
| | C-13 from dispersion 701 | 0.423 g/m$^2$ |
| | S-1 | 0.238 g/m$^2$ |
| | ST-4 | 0.005 g/m$^2$ |

-continued

| LAYER | COMPONENT | AMOUNT |
|---|---|---|
| | F-1 | 0.054 g/m$^2$ |
| | Gelatin | 1.292 g/m$^2$ |
| Support | Polyethylene laminated paper with $TiO_2$/ZnO in the polyethylene laminated in the first layer side, precoated with 3.23 g/m$^2$ gelatin. | |

In the final layer bis(vinylsulfonylmethyl) ether (0.100 g/m$^2$) was added as hardener.

Coating examples 802–809 were prepared similarly to example 801, using dispersions 702–709 described above.

The coatings were exposed for 0.10 s at a color temperature of 3000K through a Wratten W29 filter and a 0–3 density 21-step tablet, and were processed through the Kodak RA-4 process.

The following table shows data relating to the photographic activity, light stability, and heat stability, and ferrous ion sensitivity of the coatings.

The activity of each dispersion was evaluated by measuring the red reflection density at the maximum exposure.

To obtain light stability information, each coating was covered with a UV filter layer coated on cellulose acetate support, containing 0.32 g/m$^2$ of a 15:85 by weight mixture of UV absorbers UV-1 and UV-2, 0.11 g/m$^2$ of solvent S-8, 0.037 g/m$^2$ of ST-4, and 0.63 g/m$^2$ of gelatin. The coatings were subjected to 14 day 50 klx irradiation with a daylight source. The light stability of the coating was measured as red reflection density loss from density 1.0.

The red density loss from 1.0 density for each coating was measured after treatment at 75° C. and 50% relative humidity for 28 days.

The ferrous ion sensitivity was measured by treating processed samples of each coating for 5 minutes at 40° C. in a nitrogen-purged solution prepared from water (7.0 L), ethylenediaminetetraacetic acid (EDTA, 256.8 g), $FeSO_4$ (222.4 g), all adjusted to pH 5.00 with aqueous ammonia. The coatings were washed with water for 5 minutes, dried, and the red density loss at 1.0 initial density was measured within 60 minutes.

| Sample/ Coupler | Polymer Polymer:Coupler Ratio | Red $D_{max}$ | Density Loss @ 1.0 14 d 50klx | Density Loss 28 d 75° C. 50RH | $Fe^{2+}$ Loss from 1.0 | Comment |
|---|---|---|---|---|---|---|
| 801/C-13 | none | 2.64 | 0.05 | 0.57 | 0.64 | Comparison |
| 802/C-13 | P-1/1.0 | 2.61 | 0.02 | 0.46 | 0.34 | Invention |
| 803/C-13 | P-1/2.0 | 2.47 | 0.01 | 0.29 | 0.29 | Invention |
| 804/C-13 | P-17/2.0 | 3.02 | 0.00 | 0.49 | 0.61 | Invention |
| 805/C-13 | P-31/2.0 | 2.50 | 0.03 | 0.35 | 0.46 | Invention |
| 806/C-3 | none | 2.61 | 0.12 | 0.08 | 0.42 | Comparison |
| 807/C-3 | P-1/1.0 | 2.55 | 0.07 | 0.03 | 0.28 | Invention |
| 808/C-3 | P-1/2.0 | 2.57 | 0.07 | 0.00 | 0.23 | Invention |
| 809/C-3 | P-17/2.0 | 2.88 | 0.07 | 0.00 | 0.51 | Invention |

As can be seen from the table, all of the coating samples have adequate activity, with some of the dispersions of the invention showing higher dye-density formation than the comparison examples. The latex-containing dispersions of this invention show improved dye light stability and improved dye thermal stability relative to the comparisons without polymer. Most dispersions of the invention also show decreased cyan leuco dye formation after treatments with ferrous ion.

Example 10

Coating examples 901–909, blue-sensitive photographic elements comprising yellow dye-forming couplers, were prepared in a similar manner to coating samples 201–258 in example 4, using dispersions of the invention and comparison dispersions prepared in the same manner as the dispersions in example 3. All of the coated samples contained 1.54 g/m$^2$ gelatin, 0.538 g/m$^2$ coupler, and 0.248 g/m$^2$ silver in the emulsion layer. The components of the dispersions and the levels of the components in the coatings are shown in the table below.

| Sample | Coupler | Polymer/ Polymer: Coupler Ratio | Solvent and Stabilizer/ Level (g/m$^2$) | Comment |
|---|---|---|---|---|
| 901 | Y-11 | none | S-1/0.301 | Comparison |
| 902 | Y-11 | none | S-1/0.269 | Comparison |
| 903 | Y-11 | P-1/0.5 | S-1/0.301 | Invention |
| 904 | Y-11 | P-1/1.0 | S-1/0.301 | Invention |
| 905 | Y-11 | P-55/1.0 | S-1/0.269 | Invention |
| 906 | Y-11 | P-1/2.0 | S-1/0.301 | Invention |
| 907 | Y-11 | none | S-1/0.301<br>ST-6/0.237 | Comparison |
| 908 | Y-11 | P-1/1.0 | S-1/0.301 | Invention |

-continued

| Sample | Coupler | Polymer/ Polymer: Coupler Ratio | Solvent and Stabilizer/ Level (g/m$^2$) | Comment |
|---|---|---|---|---|
| 909 | Y-11 | P-1/2.0 | ST-6/0.237<br>S-1/0.301<br>ST-6/0.237 | Invention |

The coatings were exposed for 0.10 s at a color temperature of 3000K through a Wratten W98 filter and a 0–3 density 21-step tablet, and were processed through the Kodak RA-4 process as in example 4. The following table shows the maximum image density of each coating, and the light stability and hue of the formed images as evaluated for the coatings in example 4.

| Sample | Polymer Polymer:coupler ratio | Blue $D_{max}$ | Density Loss 14 d 50klx from 1.0 | Density Loss 14 d 50klx from 0.5 | Hue, 1.0 D @ 500 nm/ D @ $\lambda_{max}$ | Comment |
|---|---|---|---|---|---|---|
| 901 | none | 2.42 | 0.61 | 0.39 | 0.526 | Comparison |
| 902 | none | 2.31 | 0.64 | 0.39 | 0.552 | Comparison |
| 903 | P-1/0.5 | 2.42 | 0.30 | 0.25 | 0.509 | Invention |
| 904 | P-1/1.0 | 2.42 | 0.21 | 0.18 | 0.505 | Invention |
| 905 | P-55/1.0 | 2.43 | 0.22 | 0.19 | 0.527 | Invention |
| 906 | P-1/2.0 | 2.71 | 0.14 | 0.12 | 0.499 | Invention |
| 907 | none | 2.46 | 0.14 | 0.15 | 0.517 | Comparison |
| 908 | P-1/1.0 | 2.44 | 0.11 | 0.11 | 0.496 | Invention |
| 909 | P-1/2.0 | 2.62 | 0.10 | 0.09 | 0.502 | Invention |

As shown in this table, latex dispersions of the invention with a variety of yellow couplers show excellent image permanence and dye hue, compared to conventional dispersions without latex.

Example 11

A multilayer photographic negative element is produced by coating the following layers on a cellulose triacetate film support (coverage are in grams per meter squared, emulsion sizes as determined by the disc centrifuge method and are reported in Diameter×Thickness in microns).

Layer 1 (Antihalation layer): black colloidal silver sol at 0.151; gelatin at 2.44; UV-7 at 0.075; UV-8 at 0.075; DYE-4 at 0.042; DYE-5 at 0.088; DYE-6 at 0.020; DYE-7 at 0.008 and ST-17 at 0.161.

Layer 2 (Slow cyan layer): a blend of two silver iodobromide emulsions sensitized with a 1/9 mixture of RSD-2/RSD-3: (i) a small tabular emulsion (1.1×0.09, 4.1 mol %

I) at 0.430 and (ii) a very small tabular grain emulsion (0.5×0.08, 1.3 mol % I) at 0.492; gelatin at 1.78; cyan dye-forming coupler C-2 at 0.538; bleach accelerator releasing coupler B-1 at 0.038; masking coupler MC-1 at 0.027.

Layer 3 (Mid cyan layer): a red sensitized (same as above) silver iodobromide emulsion (1.3×0.12, 4.1 mol % I) at 0.699; gelatin at 1.79; C-2 at 0.204; D-6 at 0.010; MC-1 at 0.022.

Layer 4 (Fast cyan layer): a red-sensitized (same as above) tabular silver iodobromide emulsion (2.9×0.13, 4.1 mol % I) at 1.076; C-2 at 0.072; D-6 at 0.019; D-5 at 0.048; MC-1 at 0.032; gelatin at 1.42.

Layer 5 (Interlayer): gelatin at 1.29.

Layer 6 (Slow magenta layer): a blend of two silver iodobromide emulsions sensitized with a 6/1 mixture of GSD-1/GSD-2: (i) 1.0×0.09, 4.1 mol % iodide at 0.308 and (ii) 0.5×0.08, 1.3% mol % I at 0.584; magenta dye forming coupler M-5 at 0.269; masking coupler MC-2 at 0.064; stabilizer ST-5 at 0.054; gelatin at 1.72.

Layer 7 (Mid magenta layer): a green sensitized (as above) silver iodobromide emulsion: 1.3×0.12, 4.1 mol % iodide at 0.968; M-5 at 0.071; MC-2 at 0.064; D-7 at 0.024; stabilizer ST-5 at 0.014; gelatin at 1.37.

Layer 8 (Fast magenta layer): a green sensitized (as above) tabular silver iodobromide (2.3×0.13, 4.1 mol % I) emulsion at 0.968; gelatin at 1.275; Coupler M-5 at 0.060; MC-2 at 0.054; D-1 at 0.0011; D-4 at 0.0011 and stabilizer ST-5 at 0.012.

Layer 9 (Yellow filter layer): AD-1 at 0.108 and gelatin at 1.29.

Layer 10 (Slow yellow layer): a blend of three tabular silver iodobromide emulsions sensitized with sensitizing dye BSD-2: (i) 0.5×0.08, 1.3 mol% I at 0.295 (ii) 1.0×0.25, 6 mol % I at 0.50 and (iii) 0.81×0.087, 4.5 mol % I at 0.215; gelatin at 2.51; yellow dye forming couplers Y-14 at 0.725 and Y-15 at 0.289; D-3 at 0.064; C-2 at 0.027 and B-1 at 0.003.

Layer 11 (Fast yellow layer): a blend of two blue sensitized (as above) silver iodobromide emulsions: (i) a large tabular emulsion, 3.3×0.14, 4.1 mol % I at 0.227 and (ii) a 3-D emulsion, 1.1×0.4, 9 mol % I at 0.656; Y-14 at 0.725; Y-15 at 0.289; D-3 at 0.029; C-2 at 0.048; B-1 at 0.007 and gelatin at 2.57.

Layer 12 (UV filter layer): gelatin at 0.699; silver bromide Lippman emulsion at 0.215; UV-7 at 0.011 and UV-8 at 0.011.

Layer 13 (Protective overcoat): gelatin at 0.882.

Hardener bis(vinylsulfonyl)methane hardener at 1.75% of total gelatin weight), antifoggants (including 4-hydroxy-6-methyl-1,3,3a,7-tetraazaindene), surfactants, coating aids, emulsion addenda, sequestrants, lubricants, matte and tinting dyes are added to the appropriate layers as is common in the art.

DYE-4:

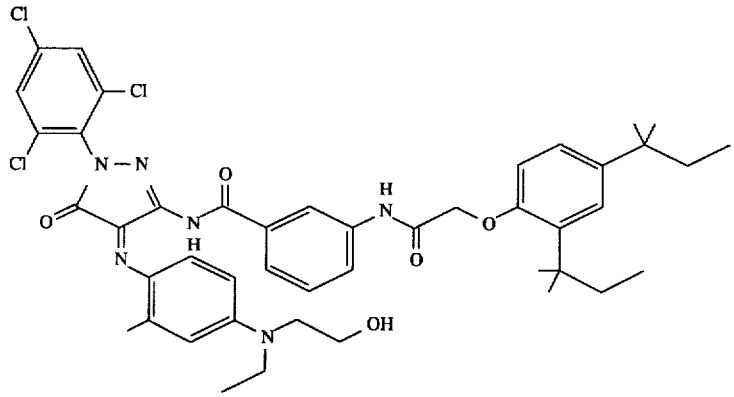

DYE-5:

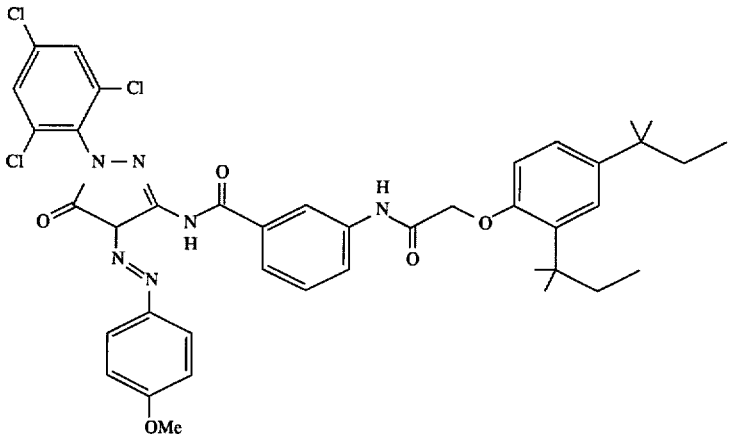

-continued
DYE-6:
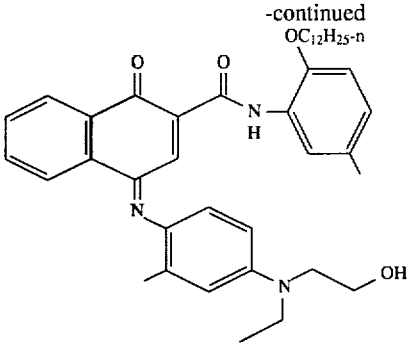
DYE-7:
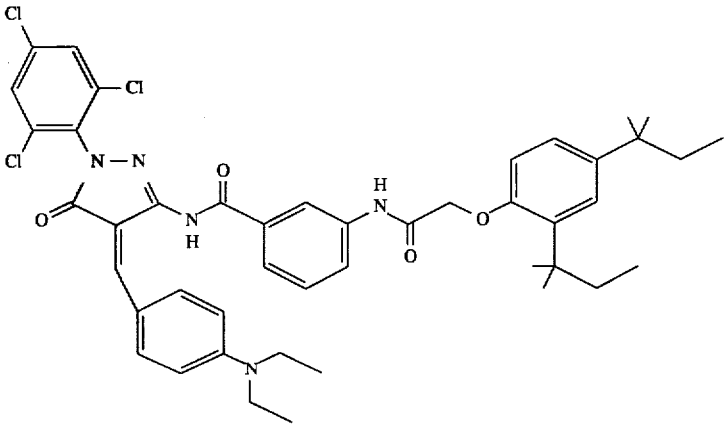
B-1:
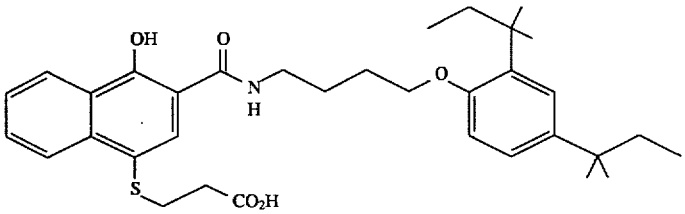
MC-1:
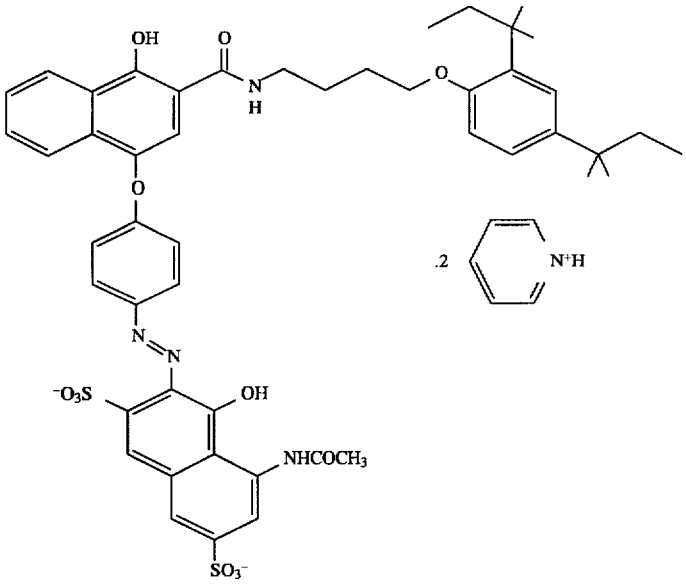

-continued
MC-2:
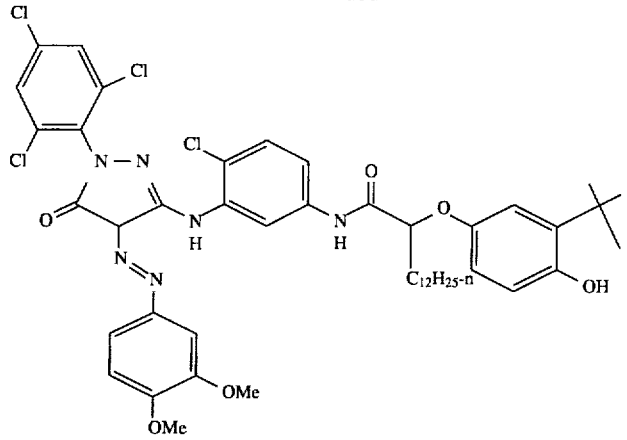
AD-1
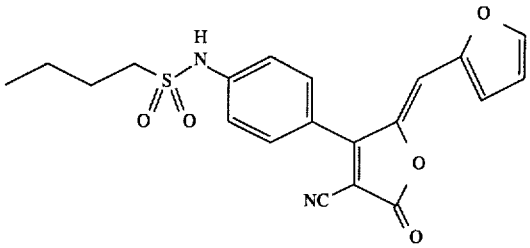
RSD-2:
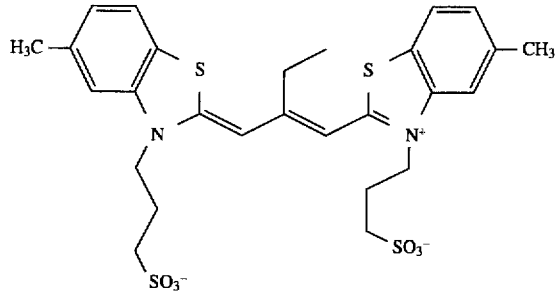
RSD-3:
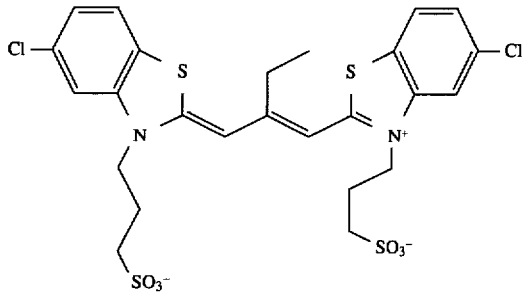
GSD-1:
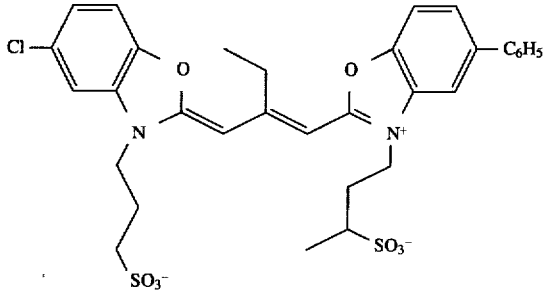

-continued

GSD-2:

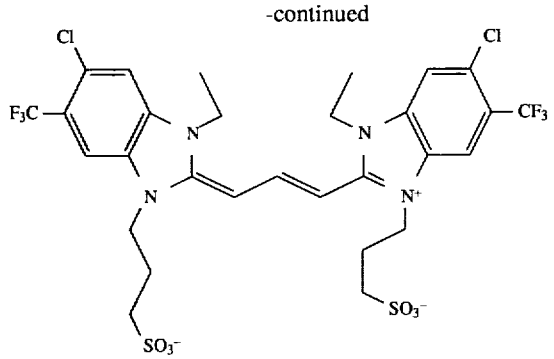

BSD-2:

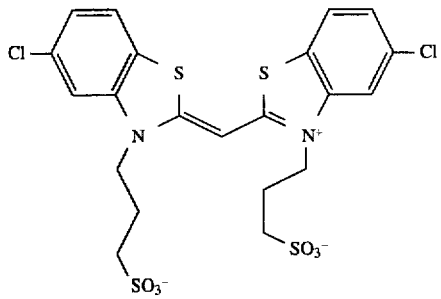

Additional coating samples are prepared similarly using dispersions of the invention comprising polymer P-17 with couplers C-2, Y-14, Y-15, and M-5. Polymer:Coupler ratios in the dispersions range from 0.5:1.0 to 5.0:1.0. The dispersions of the invention show lower turbidity than the comparison dispersions, indicating smaller dispersion particle size. The photographic elements of the invention exhibit improved performance in many cases, including enhanced sensitometric performance, improved image permanence and greater physical durability.

While the invention has been described in detail and with reference to specific embodiments thereof, it will be apparent to one skilled in the art that various changes and modifications can be made therein without departing from the spirit and scope thereof.

What is claimed is:

1. A process for forming a photographic dispersion comprising mixing a liquid organic composition comprising one or more hydrophobic photographically useful compounds with an aqueous solution containing a dispersed polymer latex under conditions of high-shear or turbulence sufficient to cause loading of the hydrophobic photographically useful compound into the dispersed polymer latex wherein the pH of the mixture is not significantly changed.

2. The process of claim 1 in which essentially no volatile or water-miscible organic solvent is present during the mixing.

3. The process of claim 1 wherein the liquid organic composition is formed by combining one or more hydrophobic photographically useful compounds with one or more high-boiling solvents at a temperature sufficient to prepare a homogeneous organic solution, and the organic solution is then mixed with an aqueous solution containing gelatin, surfactant, and the polymer latex.

4. The process of claim 1 wherein the liquid organic composition is first combined with an aqueous solution containing gelatin and surfactant, and the resulting combination is then mixed with another aqueous solution containing the polymer latex.

5. The process of claim 1 wherein the hydrophobic photographically useful compound is selected from the group consisting of: photographic couplers, UV absorbers, preformed dyes, high-boiling organic solvents, reducing agents, stabilizers, developing agents, development boosters, development inhibitors and development moderators, optical brighteners, and lubricants.

6. The process of claim 5 in which the hydrophobic photographically useful compound is a photographic coupler.

7. The process of claim 6 wherein the hydrophobic photographically useful compound is a acetanilide yellow dye-forming coupler.

8. The process of claim 7 wherein the hydrophobic photographically useful compound is a pivaloylacetanilide yellow dye-forming coupler.

9. The process of claim 5 in which the hydrophobic photographically useful compound is a UV absorber.

10. The process of claim 5 in which the hydrophobic photographically useful compound is an oxidized developer scavenger.

11. The process of claim 1 in which the polymer latex is formed by free-radical emulsion polymerization.

12. The process of claim 11 in which the polymer latex comprises a crosslinked polymer.

13. The process of claim 1 in which the polymer latex comprises at least 50% N-alkylacrylamide monomer units.

14. The process of claim 13 in which the polymer latex is a poly(t-butylacrylamide) polymer latex.

15. The process of claim 1 in which the polymer latex comprises a polymer having a $T_g$ greater than 90° C.

16. The process of claim 1 in which the polymer latex comprises polymer particles having an average diameter of from 0.03–0.2 μm.

17. The process of claim 1 in which the polymer latex average molecular weight is from 300,000–5,000,000.

18. The process of claim 1 wherein the latex polymer and the liquid organic solution are present during the mixing step at ratios of from 10:1 to 1:10.

19. The process of claim 1 wherein the latex polymer and the liquid organic solution are present during the mixing step at ratios of from 1:1 to 1:5.

20. The process of claim 1 wherein the high shear or turbulent mixing is performed by means of a homogenizer, a microfluidizer, a Gaulin mill, a colloid mill, a high pressure orifice, submerged jet or interaction chamber, a blade mixer, or a sonication or ultrasound device.

21. The process of claim 1 wherein the photographic dispersion is a gelatin-free dispersion.

* * * * *